US007500763B2

(12) United States Patent
Rubtsov

(10) Patent No.: US 7,500,763 B2
(45) Date of Patent: Mar. 10, 2009

(54) LED-BASED INCAPACITATING APPARATUS AND METHOD

(75) Inventor: Vladimir Rubtsov, Los Angeles, CA (US)

(73) Assignee: Optech Ventures, Inc., Torrance, CA (US)

( * ) Notice: Subject to any disclaimer, the term of this patent is extended or adjusted under 35 U.S.C. 154(b) by 154 days.

(21) Appl. No.: 11/269,074

(22) Filed: Nov. 8, 2005

(65) Prior Publication Data

US 2008/0013311 A1 Jan. 17, 2008

(51) Int. Cl.
*F21V 9/00* (2006.01)

(52) U.S. Cl. ..... 362/231; 362/184; 362/276; 362/800; 340/573.1; 340/815.4

(58) Field of Classification Search ..... 362/184, 362/231, 237, 259, 800; 340/573.1, 815.4
See application file for complete search history.

(56) References Cited

U.S. PATENT DOCUMENTS 6,190,022 B1 * 2/2001 Tocci et al. ..... 362/259
7,180,426 B2 * 2/2007 Rubtsov ..... 362/259

* cited by examiner

*Primary Examiner*—Stephen F Husar
(74) *Attorney, Agent, or Firm*—Lawrence S. Cohen

(57) ABSTRACT

Apparatus and method for using a light source to incapacitate a subject by a pattern of temporal flashing and/or color flashing of the light source. The light source is preferably an array of light emitting diodes. A rangefinder may be used to control the light output from the light source to avoid exposing a subject to light energy beyond a maximum permissible exposure threshold.

31 Claims, 19 Drawing Sheets

DIE WITH SQUARE SHAPE (0.4x0.4mm)

DIE WITH SQUARE SHAPE (0.4x0.4mm)

LED-BASED INCAPACITATING APPARATUS AND METHOD

GOVERNMENT LICENSE RIGHTS

This invention was made with Government support under contract number NBCHC050104 awarded by the Department of Homeland Security. The Government has certain rights in the invention.

RELATED APPLICATIONS

The present application may be related to copending and commonly assigned U.S. patent application Ser. No. 10/993,698, titled "Incapacitating Flashing Light Apparatus and Method," filed on Nov. 19, 2004, the contents of which are incorporated herein by reference.

BACKGROUND

1. Field

This disclosure relates to a method and apparatus for producing flashing electromagnetic energy for incapacitating a person or animal. More particularly, the present disclosure describes flashing visible light for individual or crowd control.

2. Description of Related Art

Security devices using visible light are known in the art. For example, U.S. Pat. No. 6,007,218 describes a laser based security device that uses visible laser light at predetermined wavelengths and intensities to create temporary visual impairment to cause hesitation, delay, distraction and reductions in combat and functional effectiveness. U.S. Pat. No. 6,190,022 describes a visual security device that uses sequentially flashing multiple LEDs.

As indicated above, flashing light incapacitating apparatus may employ lasers to achieve desired incapacitating effects. However, lasers are typically expensive and, when employed in incapacitating devices, may result in unacceptable levels of eye damage. Hence, the market has not found laser-based visual incapacitating devices to be acceptable for use, especially for civilian use.

LED-based incapacitating devices are also known in the art. However, such devices typically provide insufficient illumination levels to produce desired incapacitating effects at weights that allow desirable levels of portability.

SUMMARY

Embodiments of the present invention are based on the realization that although LEDs are an attractive alternative to lasers for use in an incapacitating apparatus, LEDs require a significant increase in power to obtain an acceptable incapacitating effect. According, an embodiment of the present invention employs a LED cluster which has, at least, a first plurality of LEDs of a first color and a second plurality of LEDS of a second color, where the first color LEDs and the second color LEDs are interspersed within the cluster. The LEDs are spaced apart a minimum distance to provide a high power level which produces an incapacitating effect over a desirable field of view and at significant distances. In a preferred embodiment, a third plurality of LEDs of a third color is interspersed within the first and second pluralities.

One embodiment of the present invention comprises an apparatus that has an array of light emitting elements, a beam former, and an element that controls flashing of the light emitting elements. The light emitting elements are flashed in a pattern that has at least two phases, where each phase is a sequence of light pulses. The phases preferably differ from each other in the frequency or randomness of the light pulses within a phase and/or the number or colors of the light emitting elements flashed during each phase. Another embodiment of the present invention is method for incapacitation where a light pattern having multiple phases is used to enhance the incapacitation effect.

Another embodiment of the present invention comprises an apparatus that uses a range finder to control the output optical power from an array of light emitting elements. If a subject is within a range of the light emitting elements so as to be exposed to a power level greater than a maximum permissible exposure, the range finder detects the subject's range and reduces or eliminates the optical output accordingly. Still another embodiment comprises a method for incapacitation where the range to a subject is detected and the optical power output is controlled.

DETAILED DESCRIPTION

Figure 1:
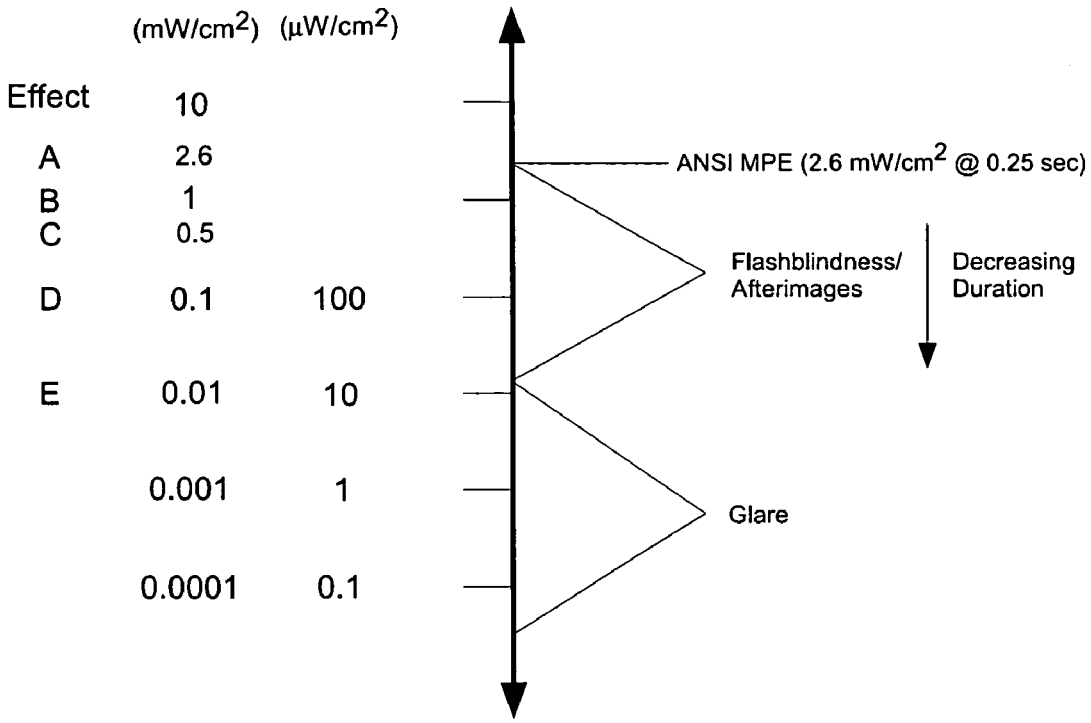
FIG. 1 shows the different levels of physiological effects that are produced from visual impairment induced by various levels of irradiance.

Embodiments of the present invention are based upon the impact on human beings when their eyes are exposed to bright, flashing light. There are three types of non-damaging effects that impact human vision when the eyes are exposed to a bright light: (1) glare, (2) flashblindness, and (3) bio-physiological effects. Which effect will occur depends on the wavelength of the light (measured in nanometers), the intensity of the light beam at the eye (measured in watts/square centimeter), whether the light source is pulsed or continuous-wave, and how many colors of light are flashing.

The glare effect is a reduced visibility condition caused by contraction of the pupil induced by a bright source of light in a person's field of view. It is a temporary effect that disappears as soon as the light source is extinguished, turned off, or directed away from the subject. Flashblindness is a reduced visibility condition that continues after a bright source of light is switched off. It appears as a spot or afterimage in an individual's vision that interferes with the ability to see in any direction. The nature of this impairment makes it difficult for a person to discern objects, especially small, low-contrast objects, or objects at a distance. The duration of the visual impairment can range from a few seconds to several minutes. The major difference between flashblindness and glare is that flashblindness persists after the light source is extinguished, whereas the glare effect does not.

The psychophysical effects of exposure to pulsed light sources are less investigated. In general, these effects are composed of a number of subjective responses ranging from distraction, to disruption, to disorientation, and to even incapacitation. This type of effect is directly related to the brain activity, and in particular to brain waves. Brain waves, periodic electrical signals that mirror shifting patterns of mental activity, tend to fall into four categories: beta, alpha, theta, and delta.

Brainwave activity tends to mirror flickering light, particularly in the alpha and theta frequencies; this effect is known as the "frequency-following effect." These findings have been used by psychologists for the therapeutic treatment of psychologically unstable patients. A number of studies, however, have indicated that many subjects find flashing lights to be very uncomfortable. Instead of treating disturbed patients, these machines cause harm, especially when the light is relatively bright.

This has led to the use of the frequency-following effect to provide a destructive effect, in nonlethal weapons. Various "less than lethal" weapons based on the frequency-following effect in military investigations have been investigated; in the majority of cases, the results of these studies are classified. Unclassified sources also report that high intensity strobe lights, which flash at or near human brain wave frequencies, cause vertigo, disorientation, and vomiting. Some devices that use stroboscopic flashing have been employed against demonstrators. In the 5-15 hertz range, these devices can cause various physical symptoms, and, in a small portion of the population, may trigger epileptic seizures.

Flash durations, colors, and the effects of rapidly changing frequencies within the alpha-theta band have been, and are still being, investigated for their effects on brain activity. The general rule of light-brain interaction from the frequency-following effect is that all three factors play an important role in modulating brain rhythms. As these factors become more variable and more random, they introduce more modulation, and thus more confusion in the brain rhythms.

Since the early 1970s, programs related to optical nonlethal weapons have been started and stopped several times. On some occasions, safety measures were ignored, and lasers (which were used as light sources in virtually all cases) caused permanent damage to an individual's eye. Embodiments of the present invention will generally use the guidance of the safety standards developed by the Laser Institute of America, ANSI Z136.1-2000, Safe Use of Lasers and Bright Light Sources. The Laser Institute safety standards provide a number of rules that should be followed for the safe use of lasers and extended sources of bright light. It is preferred that use embodiments of the present invention is non-damaging to the human eye, therefore, the intensity present at a subject's eye should be below the threshold for permanent damage. The definitive safety parameter, as defined in ANSI Z136.1-2000, is the Maximum Permissible Exposure (MPE). ANSI Z136.1-2000 presents an MPE diagram that shows the relationship between intensity and exposure, and the Eye-Damage Threshold.

The Eye Damage Threshold defines the upper boundary of the regime for eye-safe operation (typically measured in $W/cm^2$) and ranges from 0.0583 $W/cm^2$ for extremely short exposures to less than 0.0001 $W/cm^2$ for extended exposures. The lower boundary of 0.0001 $W/cm^2$ is also considered to be the lower limit of intensity for any useful degree of glare and flashblindness. For pulses shorter than 0.01 seconds, the eye typically does not respond sufficiently for any useful effects to occur. The MPE diagram provides parameters for a single exposure, but embodiments of the present invention rely upon a train of pulses to obtain an effective bio-physiological effect. Calculations for MPE for a train of pulses are discussed below.

Different levels of irradiance at the eye will have different levels of incapacitating effects. R. J. Rockwell, et al. in "Safety Recommendations of Laser Pointers," Laser-Resources, http://www.laser-resources.net/pointer-safety.htm (Apr. 15, 2003), show a chart that classifies visual impairment effects according to different intensities of light for exposure of 0.25 sec (the time equal to the aversion response or blink effect). FIG. 1 summarizes this data. FIG. 1 shows effects ranging from very strong flashblindness (which includes vertigo, disorientation, and startle) to simple glare (see right column of FIG. 1) versus irradiance level on the eye (left column of FIG. 1). The strongest effects appear when the irradiance is at the MPE level, which is 2.6 $mW/cm^2$, or above. The arrow on the right side of FIG. 1 pointing down indicates a decrease of the effectiveness, as the exposure time diminishes.

Table 1 below summarizes the various levels of impairment produced by various levels of irradiance as shown in FIG. 1. These levels (levels A-E) provide guidance as to the effects expected to be produced by some embodiments of the present invention equivalent to the effects produced by a single exposure for 0.25 seconds.

TABLE 1

| | Effects Produced | Equivalent to Irradiance Levels Shown in FIG. 1 | Required Power (% of MPE level) |
|---|---|---|---|
| A. | Very strong: severe flashblindness with afterimages, startle, disorientation, vertigo, occasional vomiting. | 2.6 $mW/cm^2$, MPE for a single exposure | 100% |
| B. | Strong: strong flashblindness with afterimages, startle, disorientation, vertigo | 1 $mW/cm^2$ | 38.4% |
| C. | Moderate to strong: strong flashblindness with afterimages, disorientation, startle | 0.5 $mW/cm^2$ | 19.23% |
| D. | Moderate: flashblindness with afterimages, disorientation, occasional startle | 0.1 $mW/cm^2$ | 3.84% |
| E. | Weak: strong glare, flashblindness, occasional afterimages | 0.01 $mW/cm^2$ | 0.384% |

The table above summarizes the effects caused by a single exposure to continuous light, but embodiments of the present invention provide trains of light pulses. Hence, MPE calculations for a train of pulses should be performed. The light sources used in embodiments of the present invention may be considered to be extended sources of radiation. An extended radiation source is defined as a source viewed by the observer at an angle larger than $\alpha_{min}$, which is 1.5 mrad. The formula for calculating $MPE_{pulses}$ in terms of source energy level for extended light sources is given in ANSI Z136.1-2000:

$$MPE_{pulses} = 1.8 \times C_E \times n^{-0.25} \times \tau^{0.75} \frac{mJ}{cm^2}, \quad \text{Eq. 1}$$

where $\tau$ is the pulse duration or exposure time, n is the number of pulses in the train, $C_E = \alpha/\alpha_{min}$ when $\alpha_{min} \leqq \alpha \leqq \alpha_{max}$, and where $\alpha_{max}$ is 100 mrad ($\alpha$ is the angle which the aperture of the device is observed from the target plane).

In terms of irradiance, for average pulse power, $$MPE\text{: } E_{pulses} = MPE_{pulse} \frac{F}{d},$$

where F is the frequency, and d is the pulse duty cycle. Since only part of the energy reaches the human retina through the iris (approximately 7 mm in diameter), the $MPE_{pulses}$ must be reduced by a factor of 0.775. The final formula is:

$$MPE\text{: } E_{pulses} = \frac{1.8 \times \tau^{0.75} \times C_E \times n^{-0.25} \times F}{0.775 \times d} \frac{mW}{cm^2}. \quad \text{Eq. 2}$$

At the preferred frequencies of 7-15 Hz, a single exposure duration of 0.25 sec is not achievable, therefore, a number of pulses should be applied to accomplish an incapacitating effect. As shown in Eq. 2, the MPE, and hence the strongest effect, could be provided at any level of irradiance by applying the respective number of pulses, while maintaining the equivalence of the other parameters. There would be more pulses at lower irradiance and vice versa. In turn, the number of pulses will define the incapacitating time. To estimate this time, the formula is rewritten as:

$$n = \left( \frac{1.8 \times \tau^{0.75} \times C_E \times F}{0.775 \times d} \times \frac{1}{MPE\text{: } E_{pulses}} \right)^4, \quad \text{Eq. 3}$$

and the irradiance emitted by the device considered to be the MPE. The number of pulses derived from Eq. 3 gives the estimated time necessary to produce the highest level of the incapacitating effect at a given irradiance, frequency, pulse duration, device aperture size, and distance to the target.

The visual impairment that is produced by intense flashing light has a cumulative effect; therefore, the dosage of radiation received depends on the number of pulses delivered. As fewer pulses are delivered, the MPE would be higher (see Eq. (1)). The number of pulses necessary to produce a visual impairment effect at a level of irradiance lower than MPE can be estimated by using the equation:

$$n_I = \frac{n_{MPE}}{A}, \quad \text{Eq. 4}$$

where $$A = \frac{I_{MPE}}{I}$$

($I_{MPE}$ is the irradiation produced by a device (which is considered the MPE); and I is the level of irradiance under consideration).

By substituting Eq. 1 for Eq. 4, the final Eq. 3 is rewritten as:

$$n = \left( \frac{1.8 \times \tau^{0.75} \times C_E \times F}{0.775 \times d} \times \frac{1}{A \times MPE\text{: } E_{pulses}} \right)^4 \quad \text{Eq. 5}$$

Eq. 5 may then be used to calculate the time durations necessary to produce visual impairments effects at levels equivalent to the single irradiance levels of 2.6, 1, 0.5, 0.1 and 0.01 $mW/cm^2$ for a given frequency of pulses. The values of A are 1, 2.6, 5.2, 26 and 260, respectively. These values were selected to provide the degrees of incapacitation (A, B, C, D, and E) shown in Table 1.

The spectral sensitivity of the human eye to visible light is well documented in numerous references. The human eye has a maximum sensitivity to green light at 532 nm in daytime conditions, and to cyan (blue-green) color at nighttime. In contrast, the sensitivity to red light (620-630 nm) is a few times less during daytime, and is extremely low at nighttime. Hence, one embodiment of the present invention flashes with at least two colors: green and cyan. This combination of colors provides for effectiveness during both daytime and nighttime conditions.

The strictly physiological effects of color are known in the art. Blue stimulates the anterior hypothalamus, which harbors the main regulating part of the parasympathetic nervous system. This means that all colors in the bluish spectrum—from blue/green through blue to violet—normally have a sedating, digestion-activating, sleep-inducing effect. Red simulates the posterior hypothalamus and therefore the sympathetic nervous system. Red provokes anger. All colors in the red spectrum—from magenta through red/orange to yellow—have a stimulating, sometimes even provocative, character. Green mediates between both systems.

A side-branch of the optic nerve tract reaches the amygdala directly, bypassing the hypothalamus. The two corpora amygdaloidea comprise the color sensitive area of the limbic system, and are highly responsive to the color to which the eyes are exposed. One study demonstrated that each monochromatic color frequency excites specific neurons. If adjacent, but dissimilar color-wavelengths are used, the same neuron stays unexcited. Each frequency in the color spectrum therefore has its own specific neurological and psychological effect. A neurosurgeon, Norman Shealy, M.D., Ph.D. conducted a study investigating biochemical changes in the brain after beaming different colors into the eye. Remarkable changes were evident in the concentration of the following neurotransmitters in the cerebro-spinal fluid: norepinephrin (having an identical structure to epinephrine, increasing heart rate, as well as blood pressure), serotonin (mood regulator, lack of norepinephrin causes depression), beta-endorphin (pain killer), cholinesterase (cholinesterase inhibition is associated with a variety of acute symptoms such as nausea, vomiting, blurred vision, stomach cramps, rapid heart rate), melatonin, oxytocin, growth-hormone, LH, prolactin, and progesterone. (These results explain why emitting different colors into the eye can have a profound effect on the hormonal system, the emotions, stress levels, sleep, brain function, and many other aspects of the person's biochemistry and well-being.)

Hence, embodiments of the present invention take advantage of both the exposure of a person to bright flashing lights and to light of selected colors.

Figure 2:
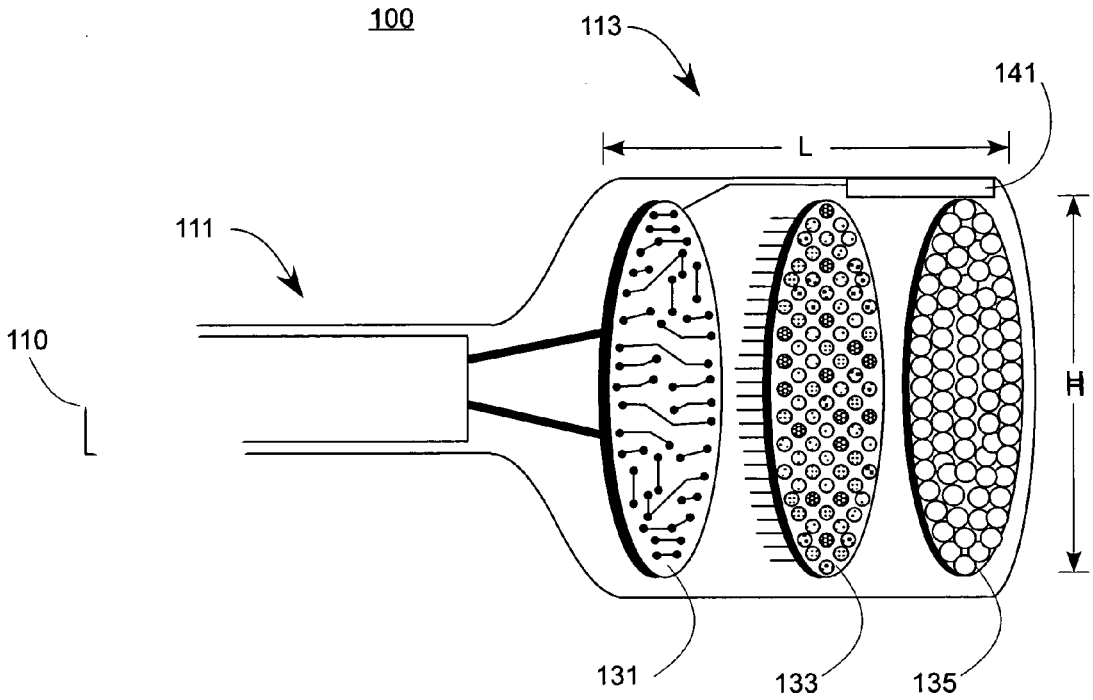
FIG. 2 is a schematic view of an exemplary embodiment of the present invention.

FIG. 2 illustrates an apparatus 100 in accordance with one embodiment of the present invention. The apparatus 100 has a case 110, which contains the operating components of the apparatus 100. The operating components comprise a power supply 121, an electronics control module 131, an LED array 133 with a cooling means, and a beam former 135. The operating components may also include a range finding device 141.

FIG. 2 shows the case 110 having the general shape of a typical flashlight, having a handle portion 111 and a head portion 113. The handle portion is preferably sized to contain the power supply 121. The head portion 113 is preferably sized with a length L and a diameter D to contain the electronics control module 131, the LED array 133, and the beam former 135. Other embodiments of the present invention may place at least some of the components in other areas of the case or may have altogether different case shapes.

The power supply 121 preferably comprises a rechargeable battery or rechargeable battery pack. One type of rechargeable battery used in an embodiment of the present invention is a high power lithium battery pack. The power supply 121 may also comprise a receptacle for connection to an external power source. The power supply 121 may also additionally comprise power conditioning electronics or circuitry for provision of proper power forms to the electronics control module 131.

The electronics control module 131 receives power from the power supply 121 and controls the emission of light from the LEDs on the LED array 133. As is described in additional detail below, the electronics control module 131 controls the flashing of the LEDs on the LED array 133 to achieve desired flash patterns. FIG. 2 depicts the electronics control module 131 as being circuitry disposed on a single circular shaped substrate, but other embodiments may use multiple substrates, electronic circuit modules, or other means or apparatus known in the art for providing and/or containing electronic circuitry.

Figure 3:
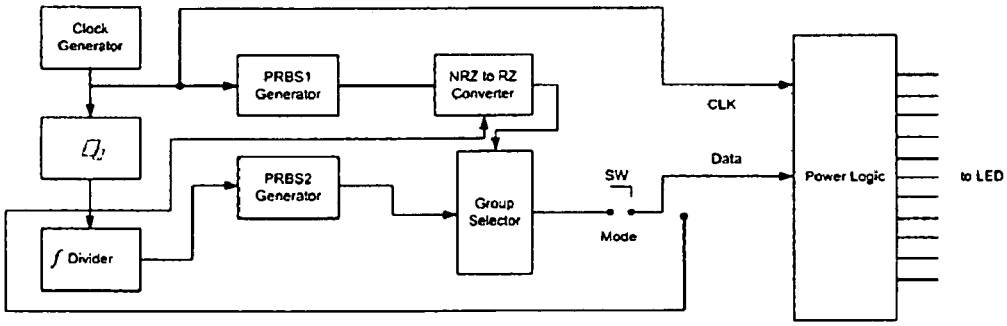
FIG. 3 shows a block diagram of a system to provide pseudorandom flashing of LEDs.
Figure 4A:
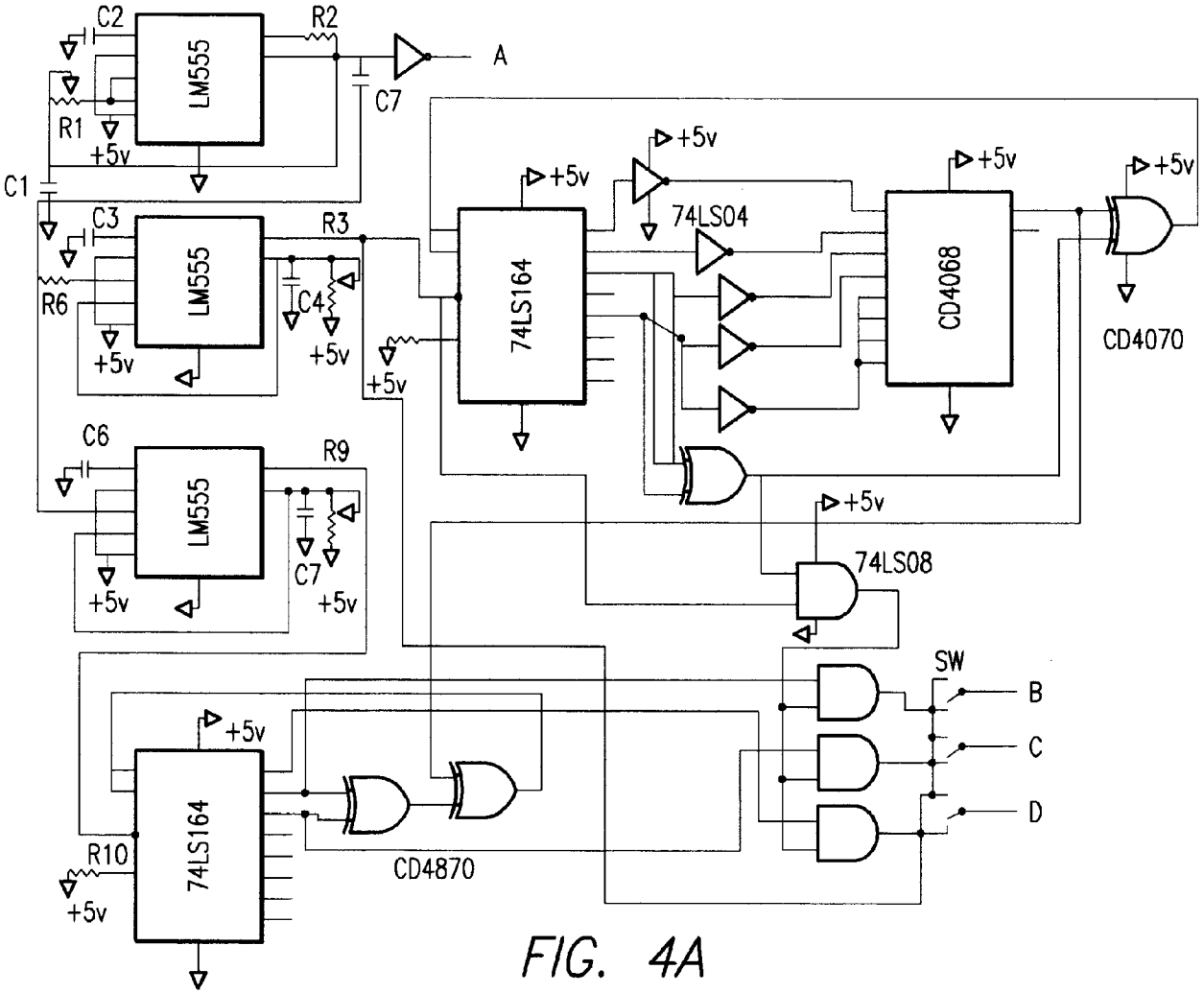
FIGS. 4A and 4B show a circuit schematic for a pseudorandom flashing control circuit.
Figure 4B:
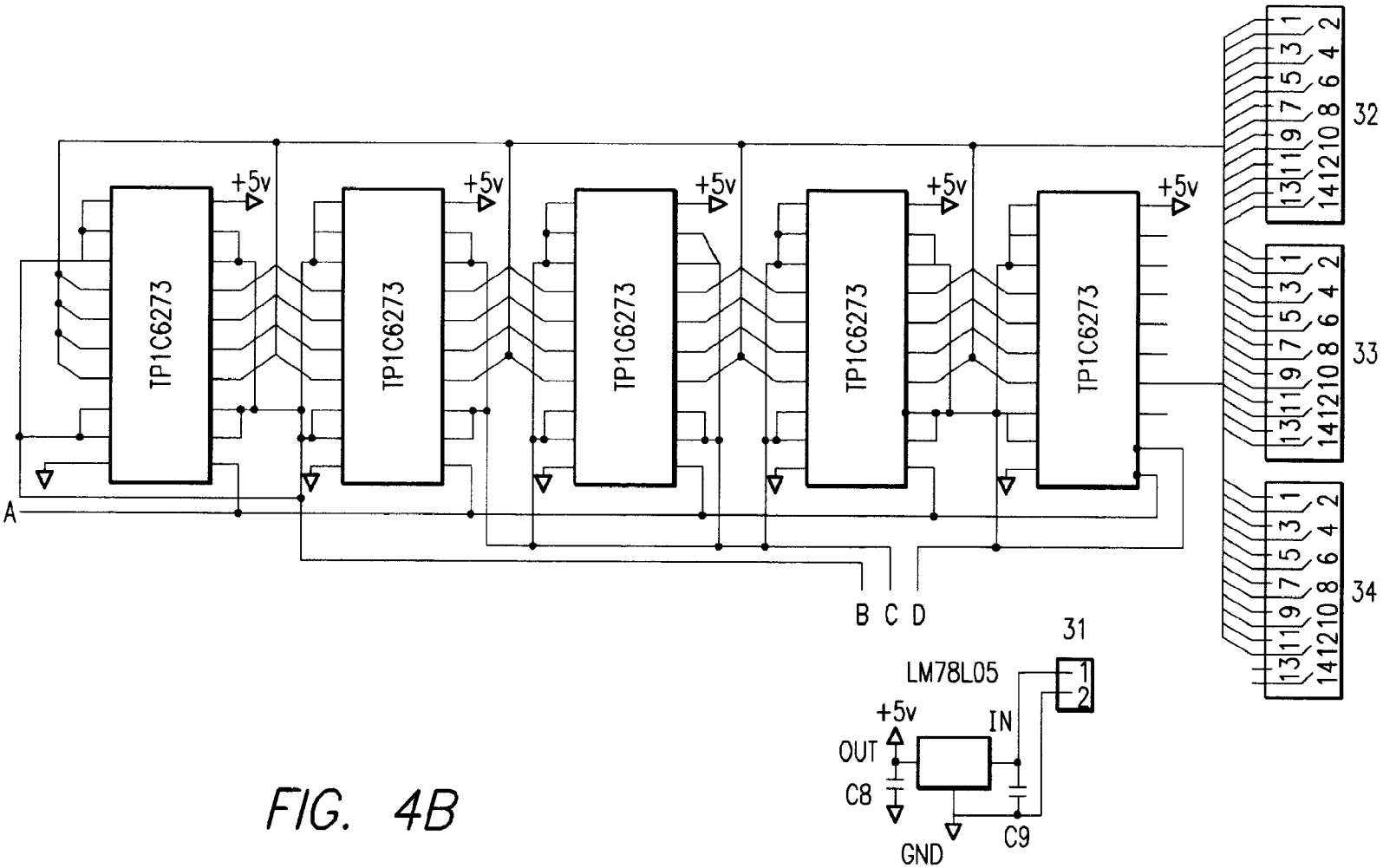

The electronics control module 131 provides the ability to flash some or all of the LEDs on the LED array 133 in a periodic and/or nonperiodic manner. The periodic manner comprises pulsing the LEDS on and off at a selected frequency, where the on duration of the LEDs is preferably less than the off duration. The selected frequency is preferably between 5 Hz and 15 Hz. The nonperiodic manner comprises pulsing the LEDs on and off, where the on durations are preferably the same, while the off durations vary randomly or pseudo randomly (as used herein the terms random and pseudorandom are taken as having the same meaning insofar as a random set of pulses is preset in the system so as to appear random to a person exposed to it, that is, it is a pseudorandom set of pulses the term also includes randomness that may be generated by a random generator). In this nonperiodic flashing, the time from the start from one light pulse to the start of the next light pulse preferably varies between 0.666 seconds and 0.2 seconds. FIG. 3 shows a block diagram for a system to provide pseudorandom flashing of the LEDs and FIGS. 4A and 4B show a circuit schematic for pseudorandom flashing control.

The LED array 133 can be an array of discrete LEDs with individual lenses or it can be one or more LED clusters. For example, one embodiment may employ high power discrete LEDs, such as the Luxeon V emitters from Lumileds, which are disposed on a surface and coupled to the electronics control module 131. The discrete LEDs preferably comprise LEDs of different colors. The Luxeon V emitter can provide a luminance flux of 160 lm, which helps obtain the high radiance that is preferred in embodiments of the present invention.

As indicated, the LED array 133 may comprise one or more LED clusters, similar to those LED clusters available from Norlux Corp. Such LED clusters typically comprise a number of light emitting dies incorporated on a metal substrate in a honeycomb arrangement. Dies emitting different colors can be fabricated on one substrate plate. The number of dies, the dimensions of the dies, and the separation between the dies define the luminance flux (or radiant power) of the cluster. Norlux has provided LED clusters with green and red dies, where the green cluster has provided a luminous flux up to 850 lm (1.9 W of radiant power) in a continuous wave mode and the red cluster has provided a luminous flux up to 600 lm (4 W of radiant power) in the continuous wave mode. Higher radiant powers are to be expected when the LED clusters are operated in a pulsed mode. The present invention contemplates use of one or more LED clusters having a plurality of colors including but not limited to cyan, red and blue.

The beam former 135 is an optical element that functions to form a desired beam or beams from the light emitted by the LED array 133. LEDs typically emit light with a high divergence angle, so the beam former preferably functions to form a light beam with a smaller divergence angle. If individual LEDs are used in the LED array 133, individual collimating LED lenses may be used with each LED. Collimating, non-imaging, single LED lenses with divergence angles of 20°, 12°, 8°, and 4° are known in the art. The use of such lenses helps increase the irradiance produced by the apparatus 100. However, as the divergence angle decreases with such a lens, the overall diameter of the lens increases. This then increases the overall diameter of the apparatus or reduces the number of individual LEDs that may be used.

Figure 5:
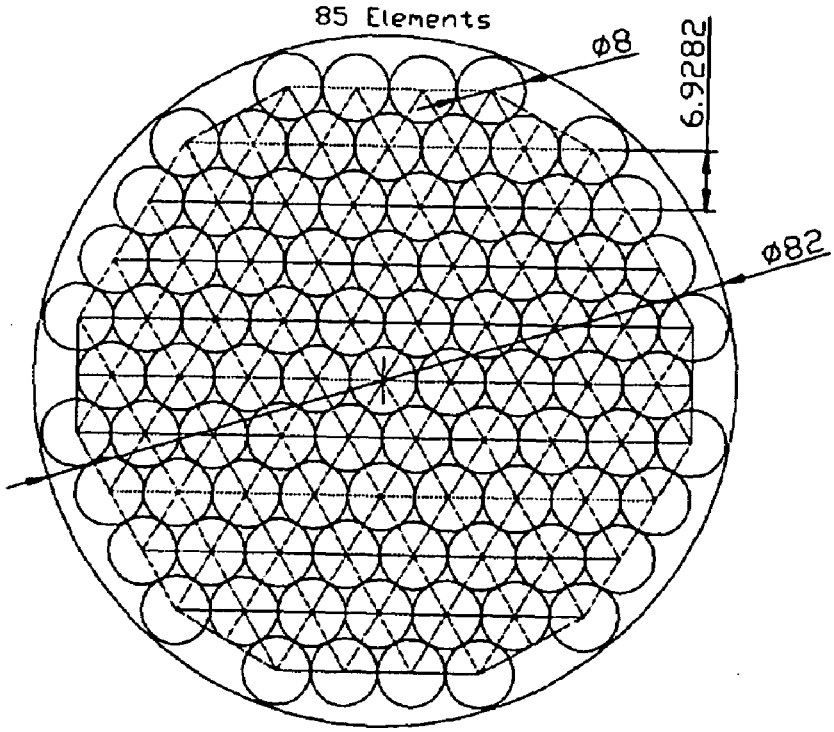
FIG. 5 illustrates the geometry of an exemplary LED cluster.
Figure 6:
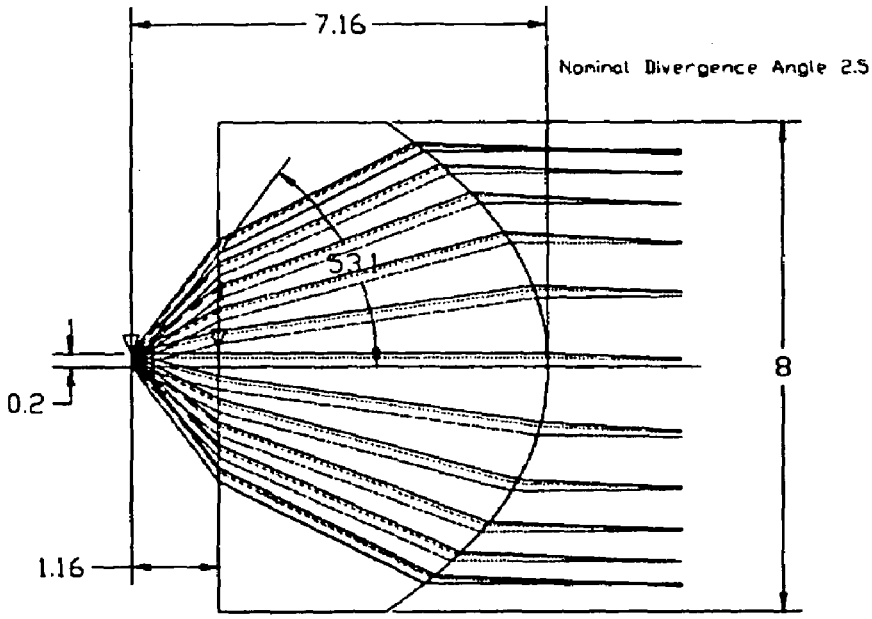
FIG. 6 illustrates the basic lens for a single lens microstructure.
Figure 7A:
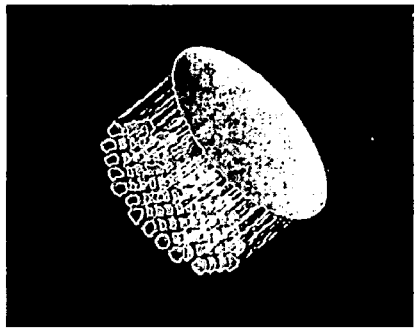
FIG. 7A shows a three-dimensional view of a single lens microstructure using the basic lens shown in FIG. 6.

If the LED array 133 comprises one or more LED clusters, the use of a single lens microstructured beam former also referred to as a compander is preferred as the beam former 135 for light emitted from the dies of the LED clusters. The single lens microstructured beam former is made of a single piece of plastic or glass having microlenses formed in it. The single piece microstructured beam former may extend over more than one LED cluster if there are more than one or separate microstructured beam formers may be used on each LED cluster. FIG. 5 illustrates a geometry for arranging the dies on a substrate. FIG. 6 illustrates the basic microlens for a single lens microstructure where a lens is disposed at each die location on the LED cluster. FIG. 7A illustrates a three dimensional view of the entire microstructured beam former using the microlenses depicted in FIG. 6.

Figure 7B:
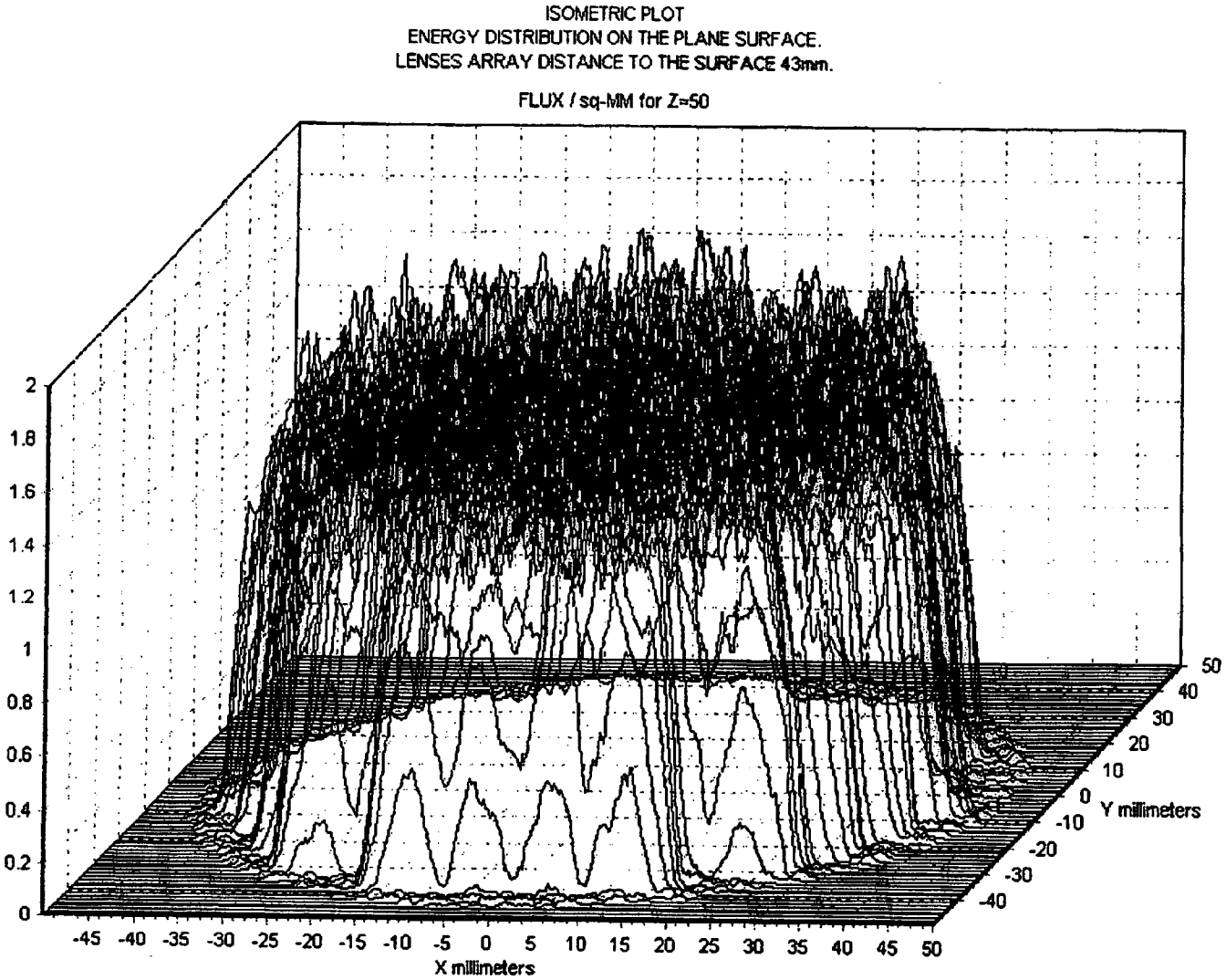
FIGS. 7B, 7C and 7D show the results for calculations based on the lens microstucture using the basic lens depicted in FIG. 6, 7A showing the lens microstructure, 7B showing 3D flux distribution, 7C showing total flux distribution graph in 5° dispersion angle and 7D showing angular radiant power distribution.
Figure 7C:
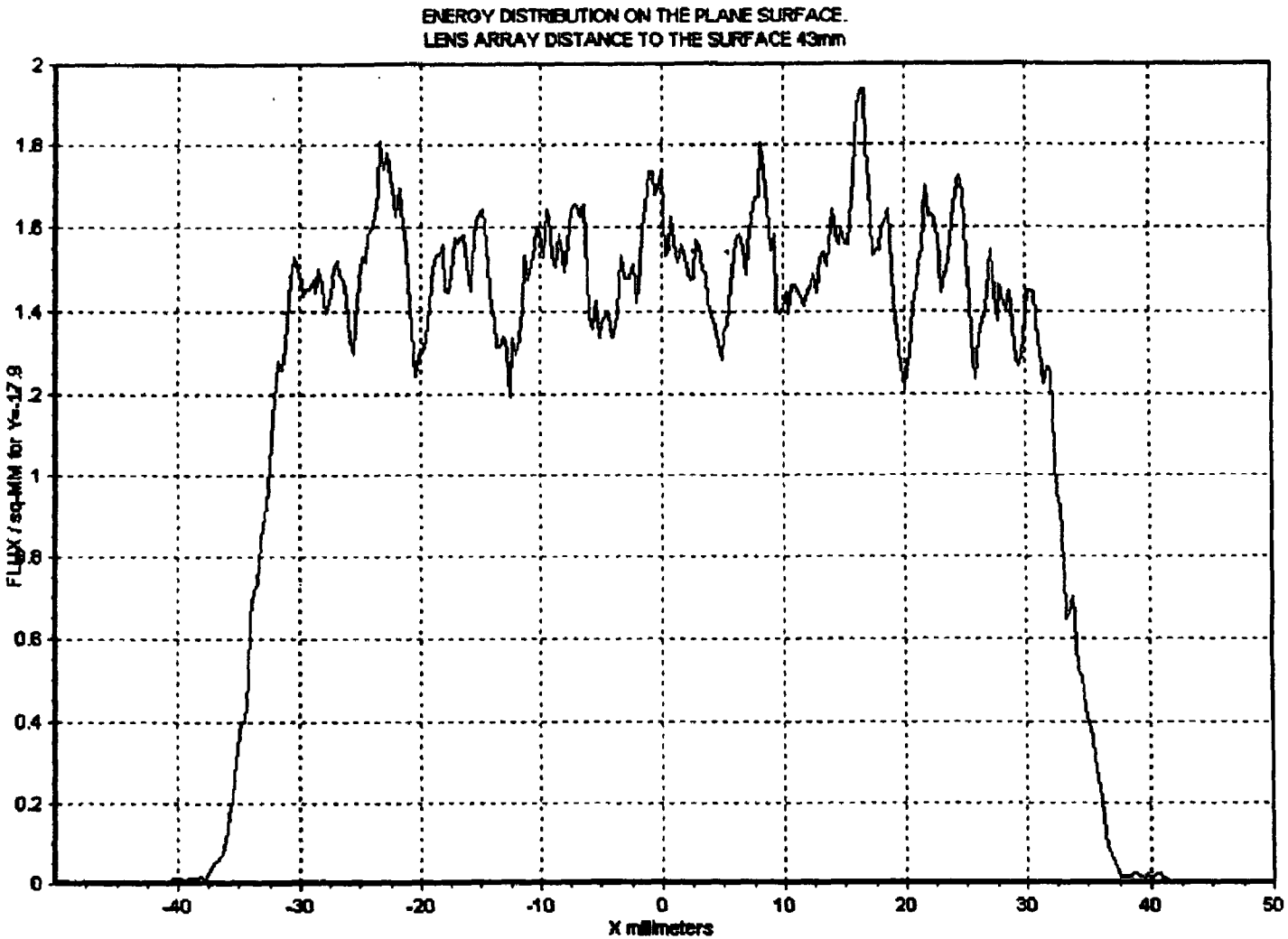
Figure 7D:
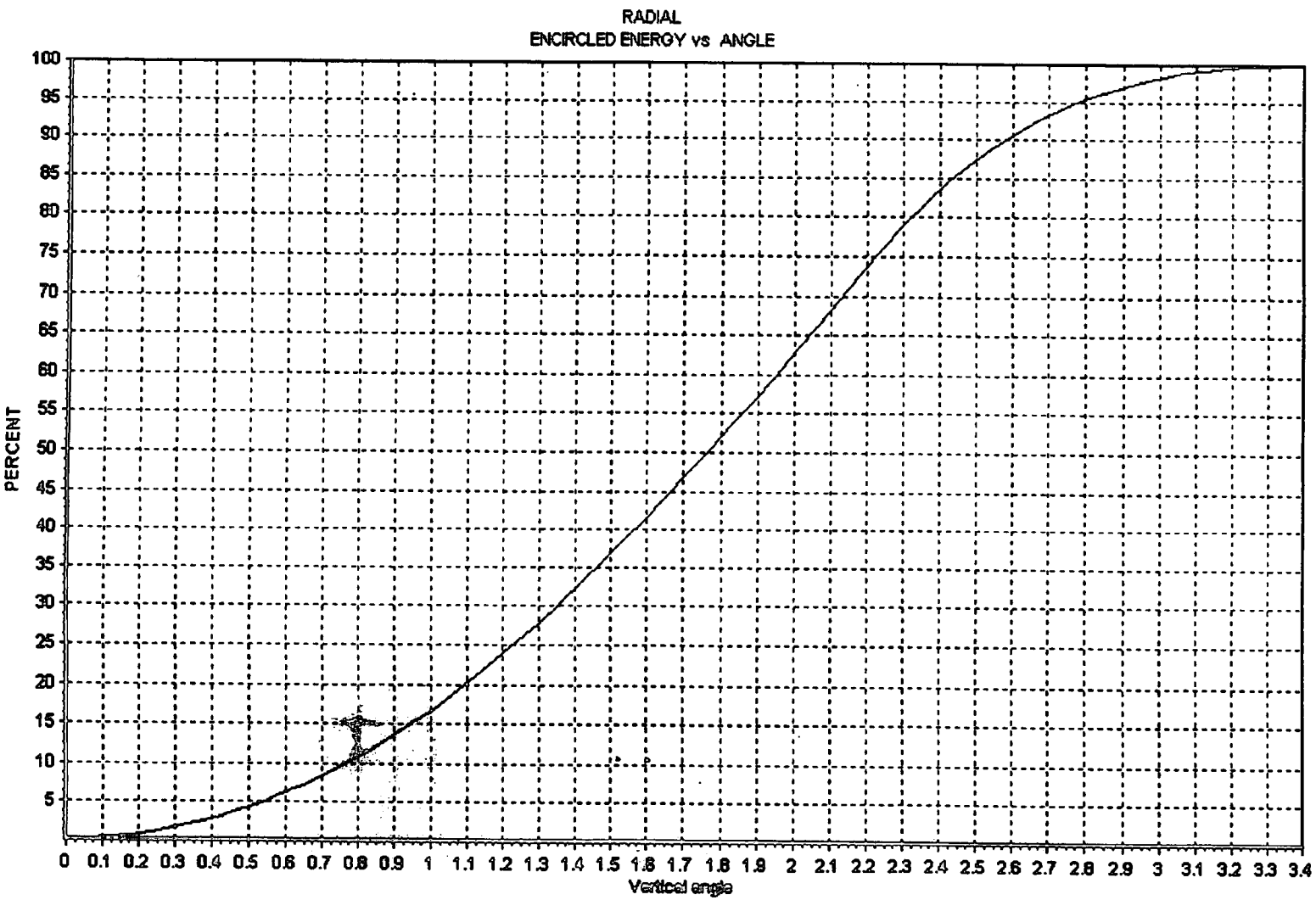
Figure 8A:
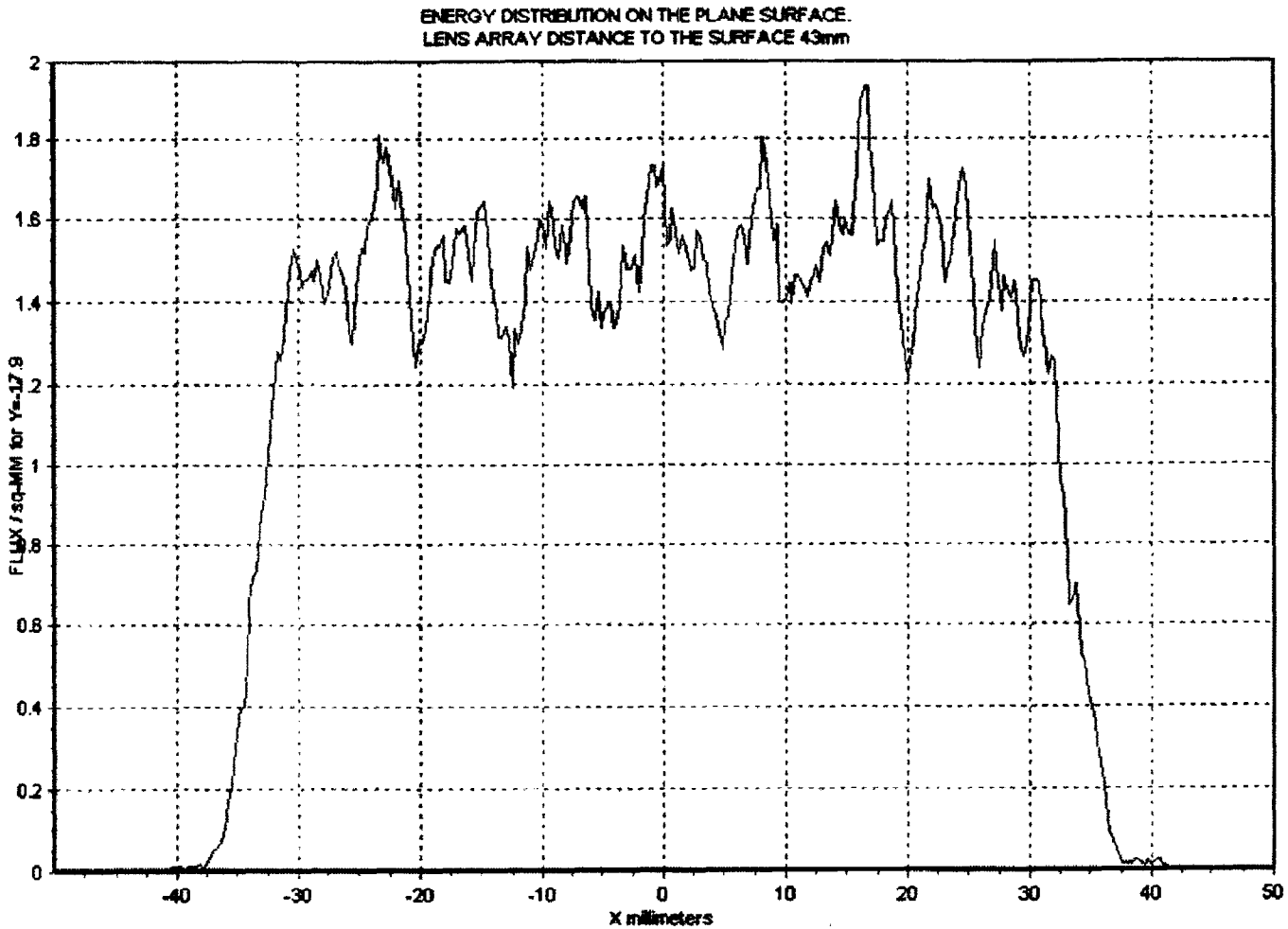
FIGS. 8A, 8B, 8C and 8D show the energy distribution along an illuminated area at different distances from a single lens microstructure using the basic lens shown in FIG. 6, 8A, 43 cm; 8B, 1 m; 8C, 5 m; 8D, 10 m.
Figure 8B:
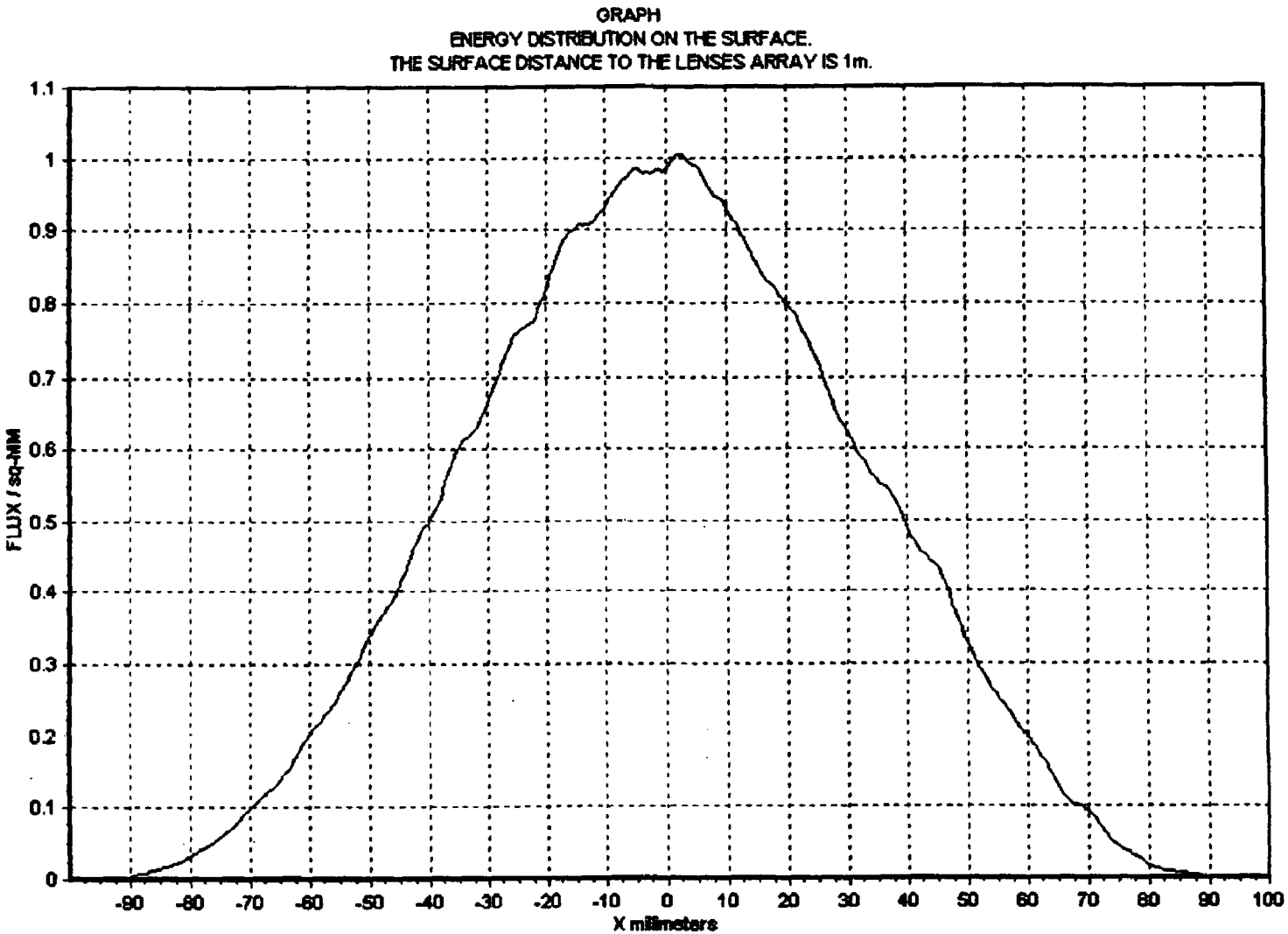
Figure 8C:
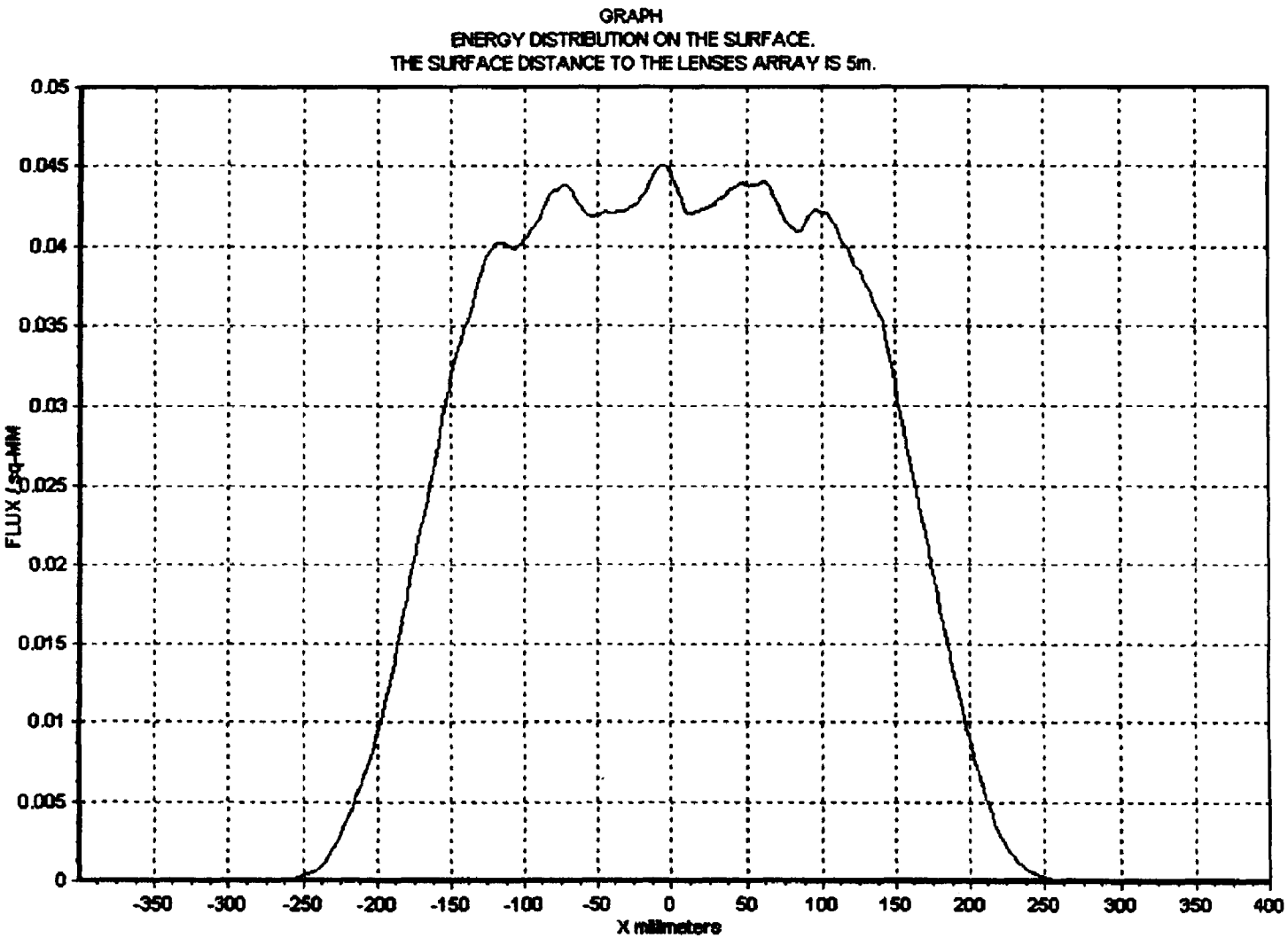
Figure 8D:
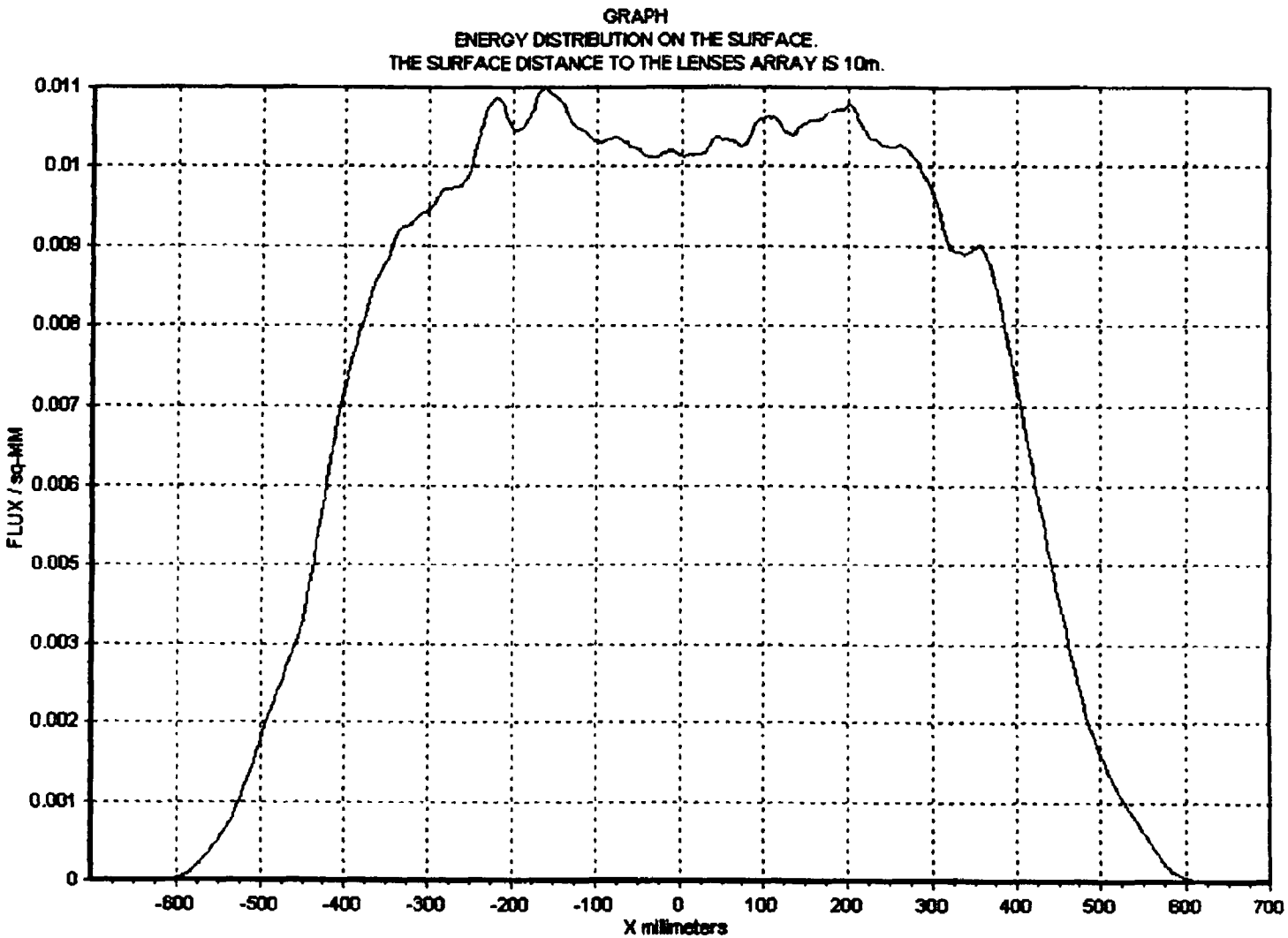

Ray tracings were performed to determine the performance of a round LED cluster with the spacing shown in FIG. 5 and a lens microstructure such as the one depicted in FIGS. 6 and 7A. The ray tracings were performed assuming circular dies on the LED cluster with diameters of about 0.4 mm and die spacing of about 8 mm. The diameter of each lens in the microstructure is 8 mm and the overall diameter of the microstructure is equal to or just slightly later than the LED cluster. The lens microstructure is preferably made with plastic from Carl Zeiss/Claret with n=1.74 and the thickness of the micro structural lens is about 7.5 mm. Such a lens could be manufactured from polycarbonate or any type of glass. Calculations based on the lens microstructure are shown in FIGS. 7B-7D. FIG. 7B shows the expected 3D flux distribution from the lens microstructure. FIG. 7C shows the total flux distribution graph. FIG. 7D shows the angular radiant power distribution. FIGS. 8A-8D show the energy distribution along an illuminated area at different distances from the lens microstructure: 8A is at 43 cm; 8B is at 1 m; 8C is at 5 m; and 8D is at 10 m.

With the lens microstructure and LED cluster combination described above, the expected divergence angle is ±2.5°, the light coupling from the source is close to 90% (the full coupling angle at which the ray tracing was performed was 106°), and the loss of light in the output beam outside the 5° full angle is less than 10%. These results present a significant improvement over other lens designs used with LED clusters, where coupling efficiencies between the cluster and lens of only 70% were seen. Hence, this combination provides a way to achieve increased output powers.

With the die diameter and die spacing described above, the overall cluster diameter would be 3.5 inches and the substrate would have 91 dies. Increased power would be obtained by increasing the number of dies on the substrate, but this would also result in an increased overall cluster diameter. Table 2 summarizes the number of dies and cluster diameters used in additional performance calculations.

TABLE 2

| | Substrate Diameter (inch) | | | | | | | | | | | | | |
|---|---|---|---|---|---|---|---|---|---|---|---|---|---|---|
| | 3 | 3.25 | 3.5 | 3.75 | 4 | 4.25 | 4.5 | 4.75 | 5 | 5.25 | 5.5 | 5.75 | 6 | 6.25 |
| N of dies | 61 | 85 | 91 | 121 | 127 | 163 | 169 | 211 | 217 | 265 | 271 | 325 | 331 | 391 |

Additional calculations were performed to account for manufacturing tolerances that may be seen in the manufacture of clusters and in lens microstructures. The die dimensions and pitches typically do not vary more that 0.1 mm. If the lens is fabricated with the usual tolerances for optics (less than 0.05 mm for stock optics), the overall tolerances would be in the 0.1 mm range. With such tolerances, the increase in beam divergence would be increased to 2.32°.

Figure 13A:
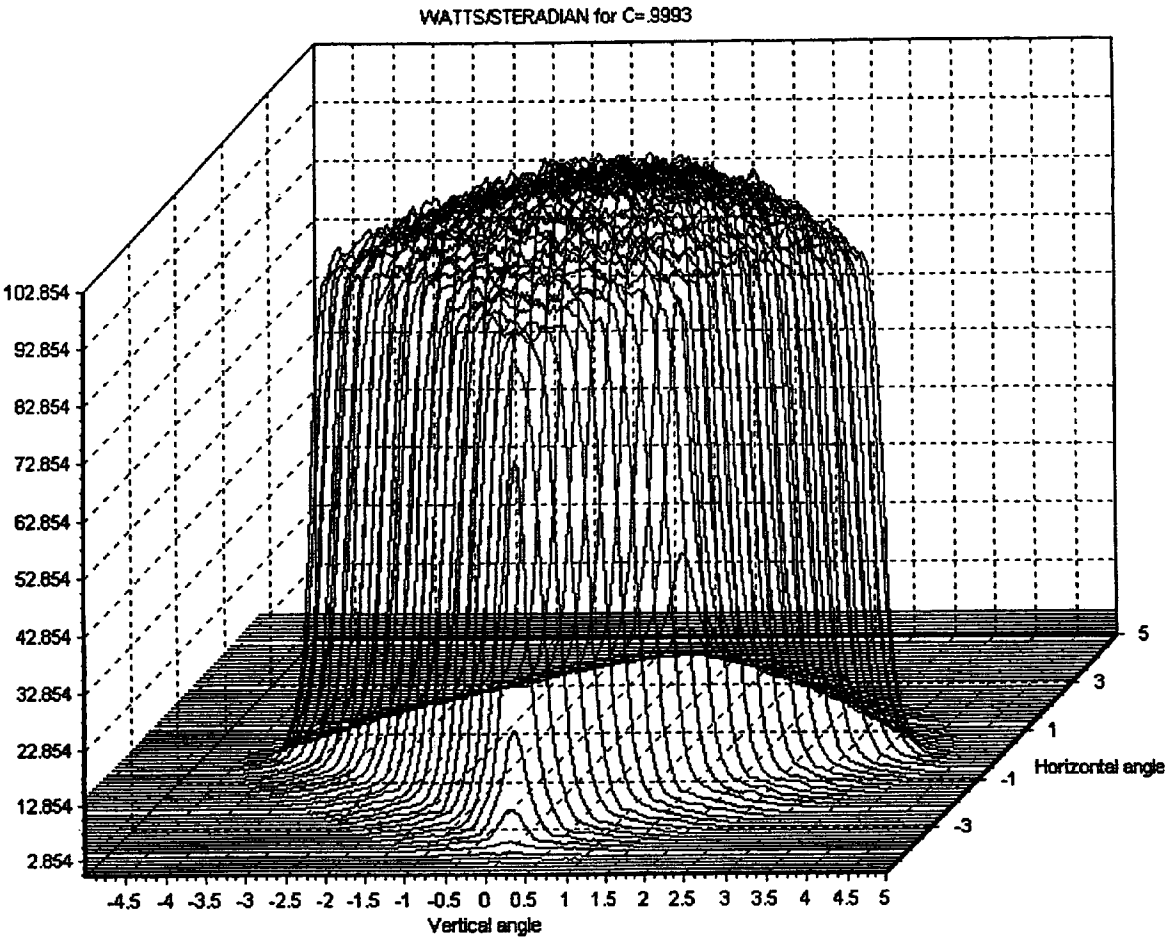
FIGS. 13A-13B show the calculation results for a beam shape for a square die with a dimension of 0.5 mm×0.5 mm, 13A showing 3-D beam shape pattern and 13B showing beam divergence.
Figure 13B:
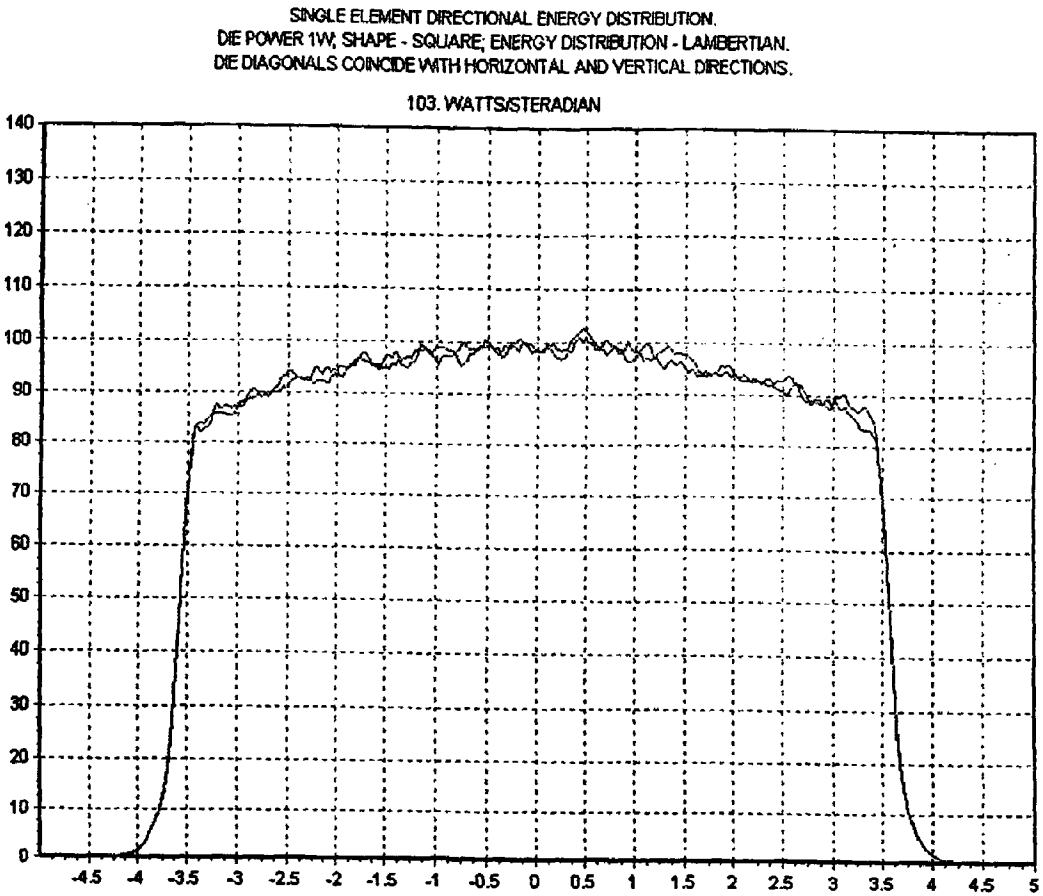

The calculations performed above were based on the use of circular dies in the LED cluster. While circular dies are available in LED clusters, manufacture of LED clusters with rectangular or square dies is typically less expensive. FIGS. 13A and 13B show the calculation results for a beam shape for a square die with a dimension of 0.5 mm×0.5 mm. FIG. 13A shows the 3-D beam shape pattern and FIG. 13B shows the beam divergence. The use of a square die would lead to an increase in the divergence angle of about 2-2.5° and would square the beam shape. Such changes would not be considered as being an appreciably reduction in performance.

A target range for operation of an apparatus according to an embodiment of the present invention is 21 feet. That is, it is desirable to be able to operate at the MPE level at a distance of 21 feet from the apparatus, since, in law enforcement conditions, this provides a minimum stand off distance for a law enforcement officer to take action if a subject tries to move within that distance. It is estimated that to achieve the MPE level at 21 feet having a spot with a radius of 28 cm with a device according to an embodiment of the present invention with a divergence angle of 5° would require that the radiant power of the device should be 40 W. LED clusters presently available from Norlux Corp. typically provide about 0.066 W optical output per die on average for dies with an area of 0.7 mm×0.7 mm at an operating frequency of 1 kHz with a duty factor of 0.1. However, at lower frequencies, the clusters can be operated at elevated duty cycles. With a duty factor of 0.3 or 0.5, the radiant power can be three to five times higher. AT a duty factor of 0.3, the output power per die is 0.2 W. For the lens described above, the die size should be reduced to 0.4 mm×0.4 mm, but this will result in a decreased output power per die of about 0.065 W. At a duty factor of 0.5, the output power per die would be about 0.11 W. As discussed above, the desired output power is 40 W, so the number of dies required to produce that power is about 614 dies at a duty factor of 0.3 and 366 dies at a duty factor of 0.5. With these dies, the cluster diameter would be close to 8" for a 614 dies and 6.25" for 366 dies. If the output power from each die could be doubled, the number of dies could be cut by one-half and 307 dies used at a duty factor of 0.3 and 183 dies at a duty factor of 0.5. This would result in cluster diameters of 5.75" and 4.75" respectively.

A preferred embodiment of the present invention comprises an LED cluster with a mix of LED colors. LED clusters from Norlux Corp. typically demonstrate a radiant power of about 33 mW/die for blue green or cyan dies and about 165 mW/die for red dies. Calculations show that using such an LED cluster from Norlux Corp. would require 682 dies and the light would be concentrated in an angle of 9° with a head format of 4-4.5 inches to achieve the desired MPE power level at 21 feet. Further enhancement of the LED cluster technology may allow for a reduction in the number of dies and a reduction in the diameter of the head. Table 3 shows the head diameter achievable at different die separations, where the head size and die calculations for irradiance angle of 9° and considering 5% loss for cyan and blue dies (square dies of 0.5 mm×0.5 mm) and 30% loss for red dies (square dies of 0.7 mm×0.7 mm).

TABLE 3

| Die separation (mm) | Head diameter at 9° angle (3.3 foot spot) at 21 feet (number of dies) | Head diameter at 5° angle (1.8 foot spot) at 21 feet (number of dies) |
|---|---|---|
| 8 | 9.44 inch (682 dies) | 5.75 inch (294 dies) |
| 6 | 7.08 inch (682 dies) | 4.7 inch (294 dies) |
| 4 | 4.72 inch (682 dies) | 3.5 inch (294 dies) |
| 3.39 | 4 inch (682 dies) | |
| 2.96 | 3.5 inch (682 dies) | |

Hence, a preferred embodiment of the present invention comprises an LED cluster combined with a lens microstructure. Such an embodiment has been shown to achieve desired MPE levels at 21 feet with relatively small-sized clusters. Such an embodiment can be easily fit within a flashlight-sized housing, which provides for portability and easy of use.

Figure 12A:
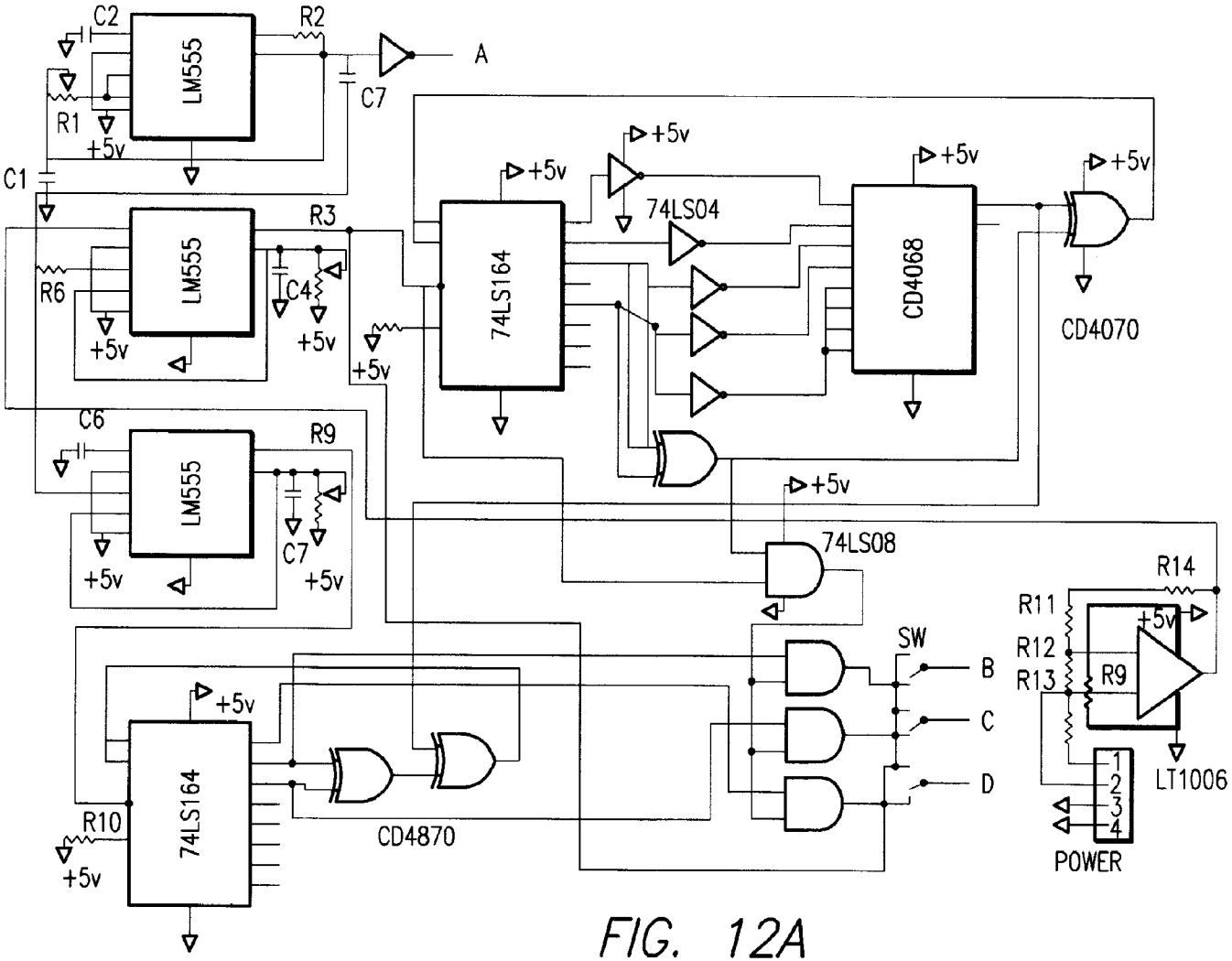
FIGS. 12A and 12B show a circuit schematic having a rangefinder feedback control for LEDs.
Figure 12B:
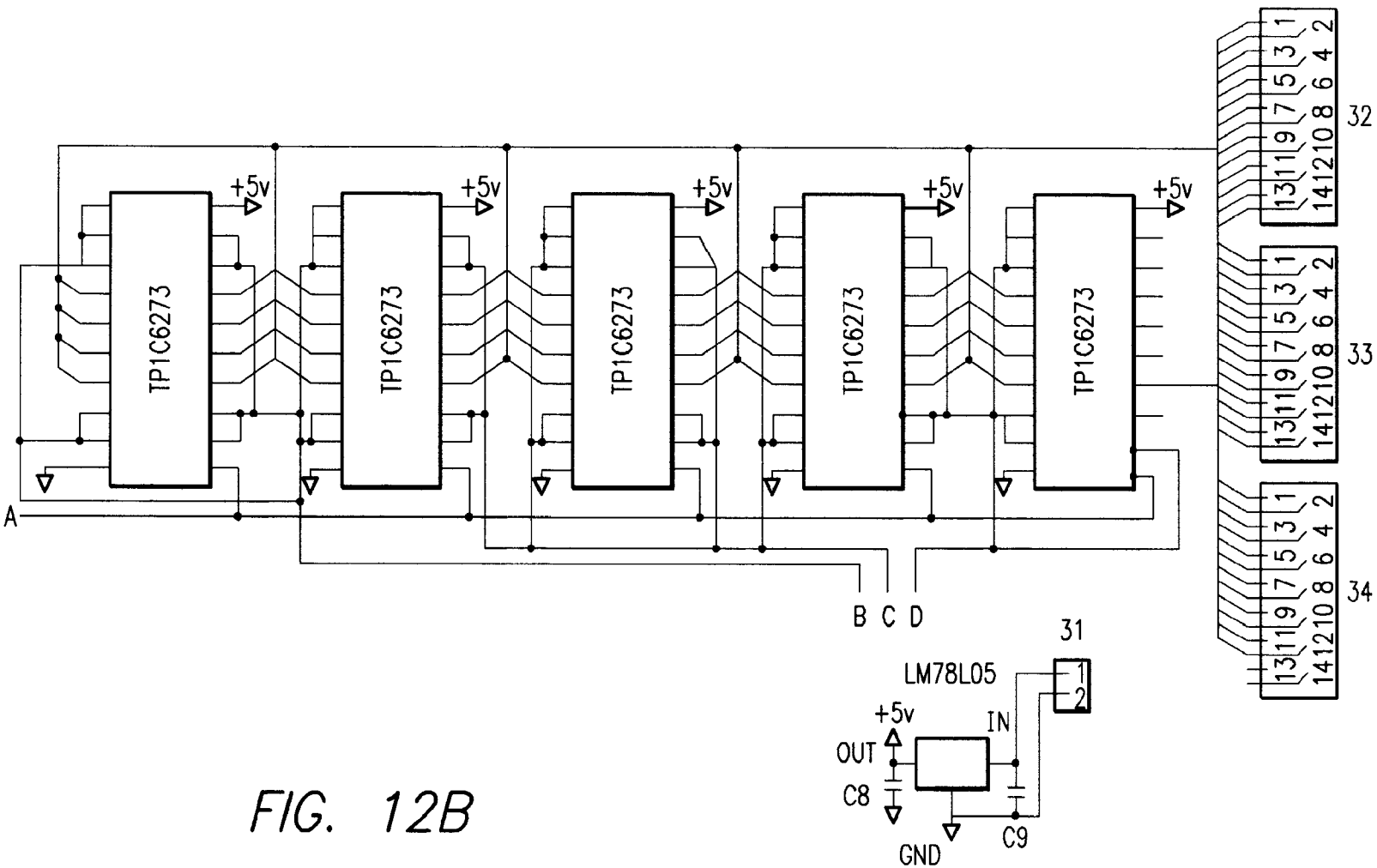

The range finding device 141 shown in FIG. 2 is used to lower or eliminate the light output from the apparatus if a subject may be exposed to power in excess of the MPE. The eye safe operation of the apparatus can be provided by a feedback electrical signal from the rangefinder to the electronics control module 131. If an object appears between the target and the apparatus, the feedback signal can be used to command the electronics to reduce or eliminate the output power. The rangefinder may comprise range finding devices known in the art, such as laser range finding devices or acoustic rangefinders. Preferred embodiments of the present invention use an acoustic rangefinder, such as the self-contained, ultrasonic analog output sensor Model SM906 from Hyde Park Electronics, LLC. FIGS. 12A and 12B show a schematic of a circuit used to control LEDs with rangefinder feedback control. Note that the rangefinder may be used to shut off all of the LEDs in the apparatus to eliminate all output optical power or shut off selected groups of LEDs to merely reduce the output optical power.

Figure 9:
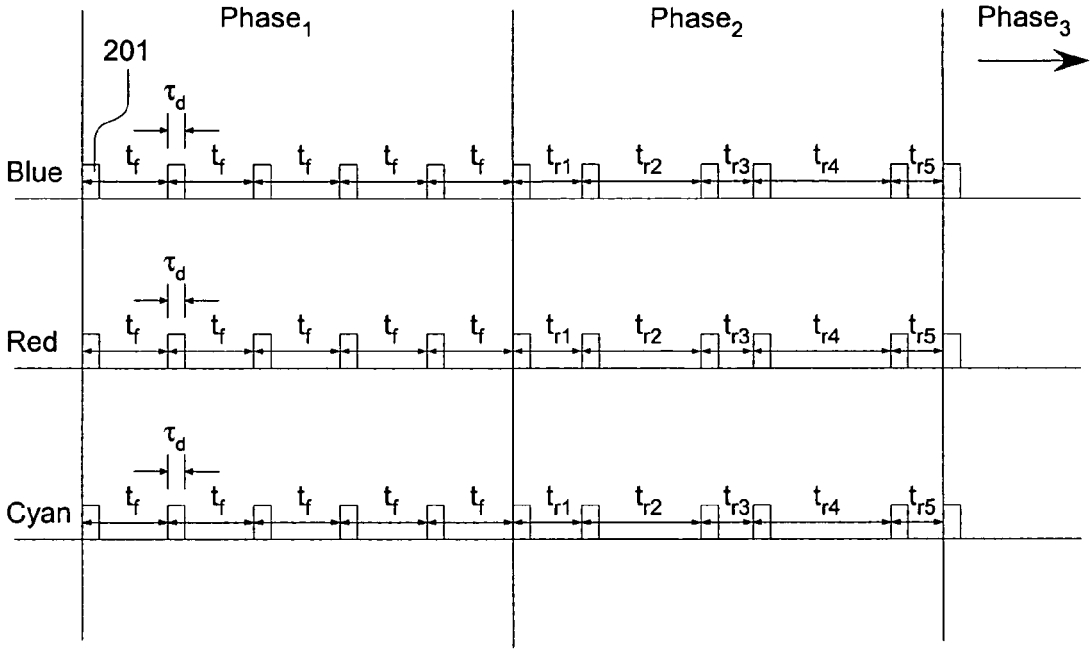
FIG. 9 shows a timeline for phases of a light pattern according to an embodiment of the present invention.

As discussed above, preferred embodiments of the present invention provide a flashing light pattern that has distinct phases. FIG. 9 shows a general timeline for two phases of a light pattern according to an embodiment of the present invention. FIG. 9 shows the timeline for light produced from LEDs of three separate colors, Blue, Red, and Cyan. Other embodiments of the present invention may have different color LEDs and may also have fewer than or more than three colors. Also note that the number of LEDs producing each color may also vary.

In FIG. 9, light pulses 201 have a constant duration $\tau_d$ seconds, while other embodiments may have lights pulses with varying durations. FIG. 9 also shows that each phase has the same duration of $t_{phase}$ seconds, while other embodiments of the present invention may have phases that vary in duration. FIG. 9 depicts the difference between a periodic phase, Phase 1, and a random or pseudorandom phase, Phase 2. In a periodic phase, the time spacing $t_f$ from the start of one light pulse 201 to the start of the next light pulse 201 is the same. Hence, the pulses repeat at a frequency of $1/t_f$. In a random or pseudorandom phase, the time spacing $t_{rx}$ from one pulse 201 to the next pulse 201 varies in a random or pseudorandom manner. Note that while FIG. 9 shows a pattern having five light pulses in each phase, each phase will typically comprise more than five light pulses. Note also that the overall light pattern may comprise repeating the phases after the phase sequence is completed.

As briefly discussed above, embodiments of the present invention typically have pulse frequencies of the periodic phases between 5 and 15 Hz, with preferred frequencies between 7 and 9 Hz. One preferred frequency is 7 Hz. In a periodic phase, the frequency remains generally fixed throughout the phase. The time spacing for pulses in random or pseudorandom phases also preferably fit within pulse frequencies between 5 Hz and 15 Hz. That is, the time spacing of random pulses vary between 0.066 seconds and 0.2 seconds. The duration of each phase is preferably between 3 seconds and 15 seconds. The duration $\tau_d$ of the light pulses is generally such that the duty factor of the light pulses is less than 50%.

FIG. 9 illustrates a preferred first phase where all or substantially all of the light emitting elements are flashed on and off in a periodic manner for some duration of time. This first phase takes advantage of the flashblindness and other incapacitating effects described above by irradiating a subject with light at or near the MPE with a flashing pattern. The random second phase of flashing all or substantially all of the light emitting elements in a random fashion has an incapacitating effect due to the bright flashing light that has a random periodicity within the frequency range of 5 Hz and 15 Hz.

Figure 10:
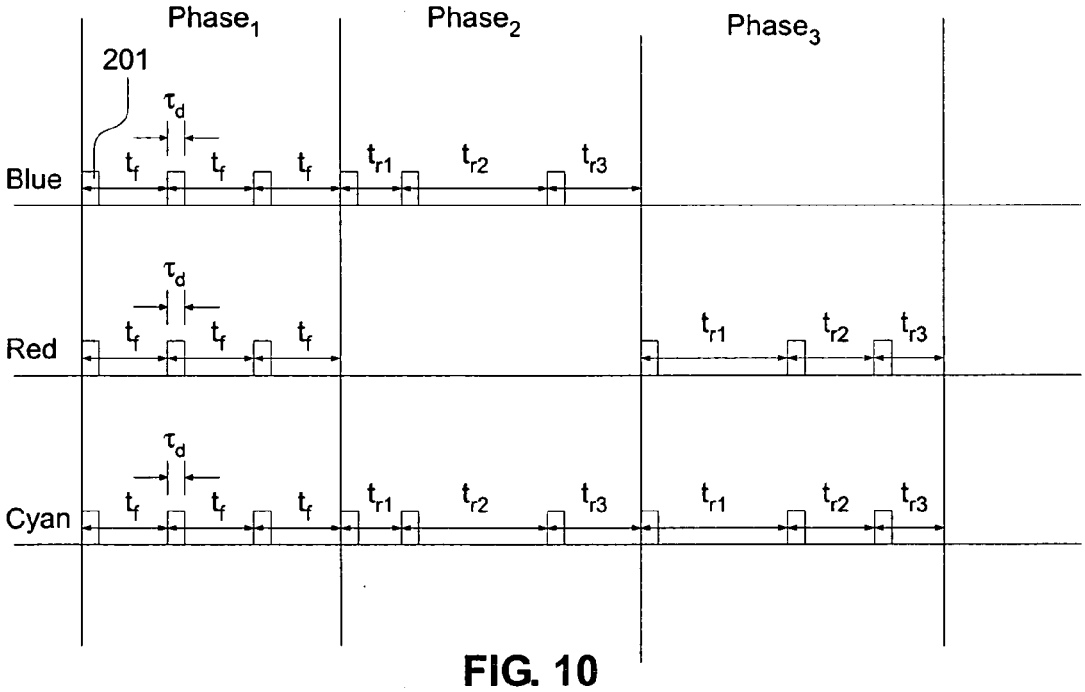
FIG. 10 shows a three phase light pattern.

FIG. 10 illustrates a three phase light pattern. The first phase comprises flashing on and off all or substantially all of the light emitting elements in a periodic manner. The second phase comprises a phase with a different duration than the first phase where two of three colors are flashed in a random manner. The third phase comprises another phase having a different duration than the first phase where a different two of the three colors are flashed in a random manner.

Figure 11:
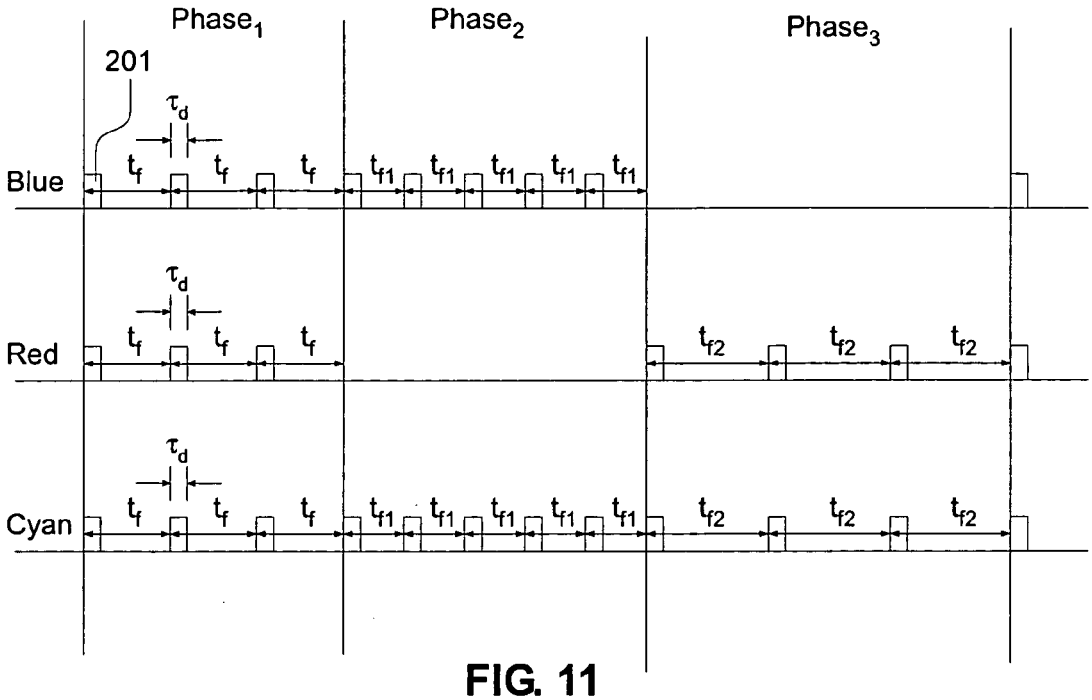
FIG. 11 shows another three phase light pattern.

FIG. 11 illustrates another three phase pattern. The first phase again comprises flashing on and off all or substantially all of the light emitting elements in a periodic manner. The second phase comprises periodically flashing two of three available colors at a first frequency, where the first frequency is preferably at a frequency near the lower bound or the upper bound of the preferred frequency range. The third phase comprises periodically flashing a different two of three available colors at a second frequency, where the second frequency is preferably at a frequency near the opposite bound of the preferred frequency range from the first frequency.

FIGS. 9, 10, and 11 do not illustrate all of the light patterns that may be used by embodiments of the present invention. Table 4 shows some additional light patterns that may be used by embodiments of the present invention, but Table 4 does not show all of the light patterns that may be used by embodiments of the present invention. In general, each phase of a light pattern differs from an adjacent phase in the power, frequency, and/or color output by the apparatus during the phase. This variation in phases is performed to overcome any adaptation by a subject to the flash pattern in any one phase.

TABLE 4

| Pattern | Phase 1 | Phase 2 | Phase 3 | Phase 4 | Phase 5 | Phase 6 | Phase 7 |
|---|---|---|---|---|---|---|---|
| 1 | All colors pulsed periodically | All colors pulsed randomly | | | Repeat phases 1 and 2 | | |
| 2 | All colors pulsed periodically | Cyan and red pulsed randomly | Blue and red pulsed randomly | | Repeat phases 1-3 | | |
| 3 | All colors pulsed periodically | Blue and cyan pulsed randomly | Cyan and red pulsed randomly | | Repeat phases 1-3 | | |
| 4 | All colors pulsed | Red and cyan pulsed | Cyan and blue pulsed | | Repeat phases 1-3 | | |

TABLE 4-continued

| Pattern | Phase 1 | Phase 2 | Phase 3 | Phase 4 | Phase 5 | Phase 6 | Phase 7 |
|---|---|---|---|---|---|---|---|
| | periodically | periodically at a low freq (pref. 5 Hz) | periodically at a high freq (pref. 15 Hz) | | | | |
| 5 | All colors pulsed periodically | All colors pulsed randomly | Cyan pulsed periodically (pref. 7 Hz) | Blue pulsed periodically (pref. 7 Hz) | Red pulsed periodically (pref. 7 Hz) | Repeat phases 1-5 | |
| 6 | All colors pulsed periodically | Cyan and red pulsed randomly | Blue and red pulsed randomly | All colors pulsed randomly | | Repeat phases 1-4 | |
| 7 | All colors pulsed periodically | Cyan and red pulsed randomly | Cyan and blue pulsed randomly | All colors pulsed randomly | | Repeat phases 1-4 | |
| 8 | All colors pulsed periodically | Red and cyan pulsed periodically at a low freq (pref. 5 Hz) | Cyan and blue pulsed periodically at a high freq (pref. 15 Hz) | All colors pulsed periodically at a freq diff. than freq of phase 1 | | Repeat phases 1-4 | |
| 9 | All colors pulsed periodically (pref. 7-9 Hz) | All colors pulsed randomly (pref. 5-15 Hz) | First color pulsed periodically | All colors pulsed randomly (pref. 5-15 Hz) | Second color pulsed periodically | All colors pulsed periodically | Third color pulsed periodically |

As discussed above, illumination near the MPE will have the most incapacitating effects. Hence, in the phases of the light patterns according to embodiments of the present invention, the power produced by the apparatus is an important factor in the overall effectiveness of the apparatus. Since flash frequencies near the fundamental frequencies of the brain have an effect, the frequency (or randomness) of the light pulses are also an important factor in the overall effectiveness of the apparatus, but probably less a factor than the power. As also discussed above, the color of the output also has en effect on a subject, but probably less an effect than power or frequency. However, the color cyan (wavelength between 495 nm and 505 nm) appears to have a particularly effective incapacitating effect. Therefore, preferred embodiments of the present invention include cyan LEDs.

The microstructured beam former (compander) based on a basic single aspherical lens collects light from an angle of 106° from round dies in an LED cluster and focuses it in a 5° angle with 87.5% of the light uniformly distributed in the 5° angle. The beam former diameter is not more than 10% larger than the diameter of the LED cluster and may be fabricated from optical grade plastic with an n=1.74. The manufacturing tolerances for stock optics leads to an increase in the beam divergence of 2.32°. Using a square die instead of a circular die leads to an increase in the divergence angle of approximately 2-2.5° and a squaring of the beam shape. FIGS. 13A and 13B show calculated results of the beam shape for a square die 0.5 mm×0.5 mm. This demonstrates that the wide cluster beam can be concentrated with one inexpensive microstructured element into a narrow angle without substantial energy losses.

Another embodiment of the present invention may also provide for use of the apparatus as a standard flashlight. If the LEDs of the LED array 133 are flashed at an elevated frequency (more than 60 Hz), the flicker of the LEDs are not distinguishable by the human eye. If the LEDs of the LED array comprise red, blue and green LEDs, operation of the LEDs at full power may produce white light on a target, in effect, operating as a standard flashlight. However, production of white light may require that the ratio of the number of LEDs of different colors be set to optimize the production of white light.

Another embodiment of the present invention may also provide for scanning the light beam without operator control to increase the area covered by the embodiment. This is accomplished without compromising irradiance on the target, since the intensity of each flash will remain the same as for an unscanned beam, as will the number of flashes per second seen at an individual location. The light energy delivered to a target area covers an area greater than the beam footprint. This prevents a subject from escaping the effect of the flashing and can affect a few subjects simultaneously. This is done by setting the device to a sequence of directions to visit a sequence of flash points resulting in a pattern that defines an area in space. In such a case, it is necessary to spatially scan the beam through a sequence of positions while flashing to ensure the delivery of the energy to effect some level of incapacitation.

This feature is not substantial if the device operates at short distances with relatively wide beam, or if the action requires few seconds of operation. At the same time in a long term actions, such as crowd control, or the control of inmate riot in prison, for example, this feature can be helpful. In one embodiment, the main operational part of the apparatus, specifically, an electronics control module 131, a LED array 133, and a beam former 135 is housed in a rigid cylindrical body. This housing is placed inside an outer protective housing, and is attached to it via a rigid rubber cylinder with certain degree of flexibility. Two miniature step-motor actuators, displaced at 90° are attached to the inside wall of the external housing. These actuators will tilt the main unit in perpendicular directions, thus providing the multidirectional strobe. The relationship between the divergence angle of the beam, required operational distance, the relative speeds of both actuators, and the main unit tilt angle in each plane defines the covered area.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. This disclosure has been made with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising step(s) for . . . ."

What is claimed is:

1. An apparatus for causing incapacitation comprising:

an LED cluster, wherein the LED cluster comprises a plurality of LED dies, the plurality of LED dies comprising at least a first plurality of LED dies of a first color and a second plurality of LED dies of a second color;

a lens microstructure forming light from the LED cluster into a beam, wherein the lens microstructure comprises a plurality of microlenses, wherein each microlens of the plurality of microlenses is disposed to receive light from a corresponding single die of the plurality of LED dies of the LED cluster;

a control element operative to cause the first plurality of LED dies and the second plurality of LED dies to flash in a prescribed pattern, wherein the number of dies in the first plurality and in the second plurality provide for a power level in the beam at a desired power level at a specified range; and further comprising a range finder operative to control the control element to prevent the power level in the beam from exceeding a maximum permissible exposure level at a detected range.

2. The apparatus according to claim 1, where the LED cluster also comprises a third plurality of LED dies of a third color.

3. The apparatus according to claim 1, wherein the first plurality comprises red LED dies, the second plurality comprises blue LED dies, and the third plurality comprises cyan LED dies.

4. The apparatus according to claim 1, wherein the lens microstructure comprises a plastic lens microstructure.

5. An apparatus for causing incapacitation comprising:

an array of light emitting elements, the array comprising light emitting elements of at least two different colors;

a beam former disposed to form one or more light beams from light from the array; and a flash control element operative to cause the light emitting elements to flash in a pattern of light pulses, wherein the pattern comprises a sequence of phases, wherein each phase comprises a sequence of light pulses from at least some of the light emitting elements, and the light pulses are produced at a constant frequency or at random or pseudorandom times during each phase, and one phase differs from an adjacent phase by variations in at least one of the following: the number of light emitting elements producing light pulses during a phase, the color or colors of light emitting elements producing light pulses during a phase, the frequency or randomness of the light pulses produced during each phase wherein the flash control element is further operative to flash substantially all of the light emitting elements at a duration and rate to provide at least one beam where flashing of the light emitting elements is not detected by a human observer.

6. The apparatus according to claim 5, wherein a first phase comprises producing light pulses from all or substantially all of the light emitting elements at a constant frequency for a specified duration of time.

7. The apparatus according to claim 5, wherein the array of light emitting elements comprises at least one multidie LED cluster of light emitting diodes and the beamformer comprises a microstructured lens.

8. The apparatus according to claim 7, wherein the multidie LED cluster comprises:

a plurality of red light emitting diodes;

a plurality of cyan light emitting diodes; and a plurality of blue light emitting diodes.

9. A method for visual incapacitation of a person or other animal comprising:

providing an array of light emitting elements, wherein the array comprises light emitting elements of at least two different colors;

forming light from the array of light emitting elements into at least one beam;

flashing the light emitting elements in a pattern, wherein the pattern comprises a sequence of phases, wherein each phase comprises a sequence of light pulses from at least some of the light emitting elements, and the light pulses are produced at a constant frequency or at random or pseudorandom times during each phase, and one phase differs from an adjacent phase by variations in at least one of the following: the number of light emitting elements producing light pulses during a phase, the color or colors of light emitting elements producing light pulses during a phase, the frequency or randomness of the light pulses produced during each phase wherein the constant frequency comprises a frequency between about 5 Hz and about 15 Hz and the random or pseudorandom times comprise time spacings between pulses between about 0.066 seconds and about 0.2 seconds.

10. The method according to claim 9, wherein the array of light emitting elements comprise at least one multidie cluster of light emitting diodes, wherein the dies of light emitting diodes are spaced apart on the cluster at a minimum distance to provide an optical power level at a maximum permissible exposure level at a specified distance from the cluster.

11. The method according to claim 10, wherein the at least one multidie cluster comprises at least two of the following pluralities:

a plurality of red light emitting diodes;

a plurality of cyan light emitting diodes; and a plurality of blue light emitting diodes.

12. The method according to claim 9, wherein a first phase comprises producing light pulses from all or substantially all of the light emitting elements at a constant frequency for a specified duration of time.

13. A method for visual incapacitation of a person or other animal comprising:

providing an array of light emitting elements, wherein the array comprises light emitting elements of at least two different colors;

forming light from the array of light emitting elements into at least one beam;

flashing the light emitting elements in a pattern, wherein the pattern comprises a sequence of phases, wherein each phase comprises a sequence of light pulses from at least some of the light emitting elements, and the light pulses are produced at a constant frequency or at random or pseudorandom times during each phase, and one phase differs from an adjacent phase by variations in at least one of the following: the number of light emitting elements producing light pulses during a phase, the color or colors of light emitting elements producing light pulses during a phase, the frequency or randomness of the light pulses produced during each phase wherein the array of light emitting elements comprise a plurality of cyan, red and blue dies and the pattern is one of the following group of patterns wherein the pattern is repeated;

pattern 1, phase 1 all colors pulsed periodically, phase 2 all colors pulsed randomly;

pattern 2, phase 1 all colors pulsed periodically, phase 2 cyan and red pulsed randomly, phase 3 blue and red pulsed randomly;

pattern 3, phase 1 all colors pulsed periodically, phase 2 blue and cyan pulsed randomly, phase 3 cyan and red pulsed randomly;

pattern 4 phase 1 all colors pulsed periodically, phase 2 red and cyan pulsed at a low frequency, phase 3 cyan and blue pulsed periodically at a high frequency;

pattern 5 phase 1 all colors pulsed periodically, phase 2 all colors pulsed randomly, phase 3 cyan pulsed periodically, phase 4 blue pulsed periodically, phase 5 red pulsed periodically;

pattern 6 phase 1 all colors pulsed periodically, phase 2 cyan and red pulsed randomly, phase 3 blue and red pulsed randomly, phase 4 all colors pulsed randomly;

pattern 7 phase 1 all colors pulsed periodically phase 2 cyan and red pulsed randomly, phase 3 cyan and blue pulsed randomly, phase 4 all color pulsed randomly;

pattern 8 phase 1 all colors pulsed periodically phase 2 red and cyan pulsed periodically at a low frequency, phase 3 cyan and blue pulsed periodically at a high frequency, phase 4 all colors pulsed periodically at a frequency different from the frequency of phase 1;

pattern 9 phase 1 all colors pulsed periodically, phase 2 all colors pulsed randomly, phase 3 a first one of the colors pulsed periodically, phase 4 all colors pulsed randomly, phase 5 a second one of the colors pulsed periodically, phase 6 all colors pulsed periodically, phase 7 a third one of the colors pulsed periodically.

14. The method of claim 13 wherein the light emitting elements are in an LED cluster and the beam is formed by a microstructured lens.

15. The method according to claim 13, wherein the array of light emitting elements comprise at least one multidie cluster of light emitting diodes, wherein the dies of light emitting diodes are spaced apart on the cluster at a minimum distance to provide an optical power level at a maximum permissible exposure level at a specified distance from the cluster.

16. The method according to claim 13, wherein a first phase comprises producing light pulses from all or substantially all of the light emitting elements at a constant frequency for a specified duration of time.

17. The method according to claim 15, wherein the at least one multidie cluster comprises at least two of the following pluralities:

a plurality of red light emitting diodes;

a plurality of cyan light emitting diodes; and a plurality of blue light emitting diodes.

18. A method for visual incapacitation of a person or other animal comprising:

providing an array of light emitting elements, wherein the array comprises light emitting elements of at least two different colors;

forming light from the array of light emitting elements into at least one beam;

flashing the light emitting elements in a pattern, wherein the pattern comprises a sequence of phases, wherein each phase comprises a sequence of light pulses from at least some of the light emitting elements, and the light pulses are produced at a constant frequency or at random or pseudorandom times during each phase, and one phase differs from an adjacent phase by variations in at least one of the following: the number of light emitting elements producing light pulses during a phase, the color or colors of light emitting elements producing light pulses during a phase, the frequency or randomness of the light pulses produced during each phase wherein the pattern comprises a first phase in which all the colors are pulsed periodically wherein the pattern comprises a second phase in which a plurality of the colors are pulsed randomly.

19. The method of claim 18 wherein the pattern comprises a third phase in which a plurality of colors being a different plurality from that of the second phase are pulsed randomly.

20. The method of claim 18 wherein the pattern comprises a third phase in which one or two colors are pulsed either randomly or periodically.

21. A method for visual incapacitation of a person or other animal comprising:

providing an array of light emitting elements, wherein the array comprises light emitting elements of at least two different colors;

forming light from the array of light emitting elements into at least one beam;

flashing the light emitting elements in a pattern, wherein the pattern comprises a sequence of phases, wherein each phase comprises a sequence of light pulses from at least some of the light emitting elements, and the light pulses are produced at a constant frequency or at random or pseudorandom times during each phase, and one phase differs from an adjacent phase by variations in at least one of the following: the number of light emitting elements producing light pulses during a phase, the color or colors of light emitting elements producing light pulses during a phase, the frequency or randomness of the light pulses produced during each phase wherein the pattern comprises a first phase in which all the colors are pulsed periodically wherein the pattern comprises a second phase in which a plurality of the colors are pulsed periodically.

22. An apparatus for causing incapacitation comprising:

an array of light emitting elements, the array comprising light emitting elements of at least two different colors;

a beam former disposed to form one or more light beams from light from the array;

a flash control element operative to cause the light emitting elements to flash in a pattern of light pulses; and a range finding element operative with the flash control element to control optical outputs from the array of light emitting elements, wherein the range finding element detects a range to a subject positioned to be illuminated by the apparatus.

23. The apparatus according to claim 22, wherein the range finding element operates to cause the flash control element to turn off some or all of the light emitting elements if the subject is within a range to cause the subject to receive illumination in excess of a maximum permissible exposure threshold.

24. The apparatus according to claim 22, wherein the range finding element comprises an acoustic rangefinder.

25. The apparatus according to claim 22, wherein the array of light emitting elements comprise at least one multidie LED cluster, wherein the dies are spaced apart on the cluster at a minimum distance to provide an optical power level at a maximum permissible exposure level at a specified distance from the cluster.

26. The apparatus according to claim 25, wherein the at least one multidie LED cluster comprises at least two of the following pluralities of dies:

a plurality of red light emitting dies;

a plurality of cyan light emitting dies; and a plurality of blue light emitting dies.

27. A method for visual incapacitation of a person or other animal comprising:

providing an array of light emitting elements, wherein the array comprises light emitting elements of at least two different colors;

determining a range from the array of light emitting elements to a subject;

forming light from the array of light emitting elements into at least one beam, if the range to the subject is greater than a range at which the subject would receive optical energy from the array of light emitting elements at a threshold greater than a maximum permissible exposure threshold; and flashing the light emitting elements in a pattern, whereby the pattern has an incapacitating effect on the person or other animal.

28. The method according to claim 27, wherein if a subject is at or has moved within the range at which the subject would receive optical energy from the array of light emitting elements at a threshold greater than the maximum permissible exposure threshold, some or all of the light emitting elements are turned off while the subject is at that range.

29. The method according to claim 27, wherein an acoustic rangefinder determines the range from the array of light emitting elements to the subject.

30. The method according to claim 27 wherein the array of light emitting elements comprise at least one multidie LED cluster, wherein the dies are spaced apart on the cluster at a minimum distance to provide an optical power level at the maximum permissible exposure level at a specified distance from the LED cluster.

31. The method according to claim 30, wherein the at least one multidie LED cluster comprises at least two of the following pluralities:

a plurality of red dies;

a plurality of cyan dies; and a plurality of blue dies.

* * * * *